US006610959B2

(12) United States Patent
Carlson et al.

(10) Patent No.: US 6,610,959 B2
(45) Date of Patent: Aug. 26, 2003

(54) SINGLE-WIRE ARC SPRAY APPARATUS AND METHODS OF USING SAME

(75) Inventors: Richard R. Carlson, Faribault, MN (US); Joachim V. R. Heberlein, North Oaks, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 09/843,188

(22) Filed: Apr. 26, 2001

(65) Prior Publication Data

US 2002/0185473 A1 Dec. 12, 2002

(51) Int. Cl.[7] ..... B23K 9/04
(52) U.S. Cl. ..... 219/76.15; 219/76.12
(58) Field of Search ..... 219/76.12, 76.15, 219/75; 118/723 DC; 427/540, 580

(56) References Cited

U.S. PATENT DOCUMENTS

| | | | | | |
|---|---|---|---|---|---|
| 2,756,311 | A | * | 7/1956 | Persson et al. | 219/74 |
| 2,868,954 | A | * | 1/1959 | Skinner et al. | 219/124.02 |
| 2,998,922 | A | * | 9/1961 | Gibson | 239/13 |
| 3,064,114 | A | | 11/1962 | Cresswell et al. | 219/74 |
| 3,549,857 | A | * | 12/1970 | Needham et al. | 219/137 R |
| 3,891,824 | A | * | 6/1975 | Essers et al. | 219/121.46 |
| 4,039,800 | A | * | 8/1977 | Essers | 219/121.36 |
| 4,233,489 | A | * | 11/1980 | Essers | 219/121.36 |
| 4,273,988 | A | | 6/1981 | Iceland et al. | 219/137 PS |
| 4,370,538 | A | | 1/1983 | Browning | 219/121.59 |
| 4,492,337 | A | | 1/1985 | Harrington et al. | 239/81 |
| 4,788,402 | A | | 11/1988 | Browning | 219/76.16 |
| 5,191,186 | A | | 3/1993 | Crapo, III et al. | 219/76.16 |
| 5,245,153 | A | * | 9/1993 | Singer et al. | 219/76.15 |
| 5,270,542 | A | | 12/1993 | McMurry et al. | 250/288 |
| 5,296,667 | A | | 3/1994 | Marantz et al. | 219/121.47 |
| 5,302,414 | A | | 4/1994 | Alkhimov et al. | 427/192 |
| 5,442,153 | A | | 8/1995 | Marantz et al. | 219/121.47 |
| 5,616,258 | A | * | 4/1997 | Dreizin et al. | 219/56.22 |
| 5,707,693 | A | * | 1/1998 | Vliet et al. | 427/449 |
| 5,796,064 | A | * | 8/1998 | Rice et al. | 219/76.16 |
| 5,808,270 | A | | 9/1998 | Marantz et al. | 219/121.47 |
| 5,938,944 | A | | 8/1999 | Baughman et al. | 219/76.16 |
| 6,001,426 | A | | 12/1999 | Witherspoon et al. | 427/449 |
| 6,005,215 | A | | 12/1999 | Boyd et al. | 219/76.14 |
| 6,017,591 | A | | 1/2000 | Popoola et al. | 427/449 |
| 6,337,455 | B1 | * | 1/2002 | Yamaguchi | 219/76.14 |

FOREIGN PATENT DOCUMENTS

| | | | |
|---|---|---|---|
| WO | WO 90/08203 | 7/1990 | C23C/4/16 |

OTHER PUBLICATIONS

Amakawa et al., "Anode–boundary–layer behaviour in a transferred, high–intensity arc", *J. Phys. D: Appl. Phys.*, 31:2826–2834 (1998).

Amson, "Lorentz force in the molten tip of an arc electrode", *J. Appl. Phys., 16*:1169–1179 (1965).

Buhrmaster et al., "Spray Casting Aluminum and Al/SiC Composites", *J. of Metals*, 40(11):44–45 (1988).

(List continued on next page.)

*Primary Examiner*—M. Alexandra Elve
*Assistant Examiner*—Kevin P. Kerns
(74) *Attorney, Agent, or Firm*—Mueting, Raasch & Gebhardt, P.A.

(57) ABSTRACT

Material droplet generator systems utilizing single-wire arc spray apparatus and methods are provided. In some embodiments, the apparatus include a single consumable, first wire electrode fed through a gas nozzle and a non-consumable, second electrode outside of and proximate a nozzle exit. In some embodiments, the second electrode may have at least a terminal or end portion having an axis that is oriented substantially perpendicular to an axis of the gas nozzle. The first wire electrode may form an angle of 5 degrees or less with the axis of the gas nozzle. Preferably, the first wire electrode forms an anode while the second electrode forms a cathode. In operation, the apparatus and methods produce a narrow beam thermal spray, which, when deposited upon a substrate surface, results in a high definition spray pattern and coating having distinct boundaries and a controllable thickness.

95 Claims, 12 Drawing Sheets

OTHER PUBLICATIONS

Carlson et al., "High Definition Single–Wire–Arc–Spray", *Proceedings of the 1st International Thermal Spray Conference*, May 8–11, 2000, Montreal, CA, ASM International, pp. 709–716 (2000).

Choi et al., "The dynamic analysis of metal transfer in pulsed current gas metal arc welding", *J. Phys. D: Appl. Phys.*, 31:207–215 (1998).

Irving, "Thermal Spray: New Technology is its Lifeblood", *Welding Journal*, 77(3):38–45 (1998).

Jones et al., "Magnetic forces acting on molten drops in gas metal arc welding", *J. Phys. D: Appl. Phys.*, 31:93–106 (1998).

Jones et al., "A dynamic model of drops detaching from a gas metal arc welding electrode", *J. Phys. D: Appl. Phys.* 31:107–123 (1998).

Kelkar et al., "Optical Diagnostics and Modeling of Gas and Droplet Flow in Wire Arc Spraying", *Proceedings of the 15th International Thermal Spray Conference*, May 25–29, 1998, Nice, France, pp. 329–334 (1998).

Lancaster et al., *The Physics of Welding, 2nd* Edition, Pergamon Press, Oxford, U.K. (1986).

Levinstein et al., "Properties of Plasma Sprayed Materials", *Welding Journal: Welding Research Supplement*, pp. 8–s—13–s (Jan. 1961).

Maecker et al., "What Keeps an Arc Standing in a Cross Flow?", *IEEE Transactions on Plasma Science,* PS –14(4):291–299 (1986).

Nemchinsky, "Size and shape of the liquid droplet at the molten tip of an arc electrode", *J. Phys. D: Appl. Phys.*, 27:1433–1442 (1994).

Pouliot et al., *DPV–2000 Reference Manual*, Tecnar Automation Ltd., St–Hubert, Qc, Canada (1998).

Raizer, "Chapter 10: Arc Discharge", *Gas Discharge Physics*, 2nd Printing, Springer–Verlag, Berlin, pp. 245–287 (1997).

Srivatsan et al., "Use of spray techniques to synthesize particulate–reinforced metal–matrix composites", *J. Material Science*, 27:5965–5981 (1992).

Steffens et al., "Recent Developments in Single–Wire Vacuum Arc Spraying", *J. Thermal Spray Technology*, 3(4):412–417 (1994).

Steffens et al., "Recent Developments in Arc Sraying", *IEEE Transactions on Plasma Science*, 18(6):974–979 (1990).

Subramaniam et al., "Droplet Transfer in Pulsed Gas Metal Arc Welding of Aluminum", *Welding Journal: Welding Research Supplement*, pp. 458–s—464–3 (1998).

Wang et al., "Effect of Nozzle Configuration, Gas Pressure, and Gas Type on Coating Properties in Wire Arc Spray", *Journal of Thermal Spray Technology*, 8(4):565–575 (1999).

H. Kayser et al., "Wire Plasma Spraying," (English language translation of "Draht–Plasmaspritzen," publication title and date unknown, pp. 47–55.

* cited by examiner

20μm 1000X

4μm 5000X

SINGLE-WIRE ARC SPRAY APPARATUS AND METHODS OF USING SAME

TECHNICAL FIELD

The present invention relates to thermal spray technology. More particularly, the present invention relates to single-wire arc spray apparatus and methods for producing a focused, narrow beam spray.

BACKGROUND OF THE INVENTION

Thermal spray processes are known for use in applying coatings to a variety of substrates such as metals, ceramics, and plastics. Moreover, such spray processes are advantageous for use in the fabrication of freestanding, three dimensional structures via the build-up of coating layers.

Generally speaking, thermal spray devices produce spray material in accordance with one of three operating principles: combustion, plasma, or wire arc. For many coating applications, wire arc spray has emerged as the technique of choice. This is primarily, although not exclusively, attributable to the ability of wire arc spray devices to yield a quality coating with the use of relatively inexpensive spraying equipment and materials. In addition, wire arc spraying has low power requirements, is energy efficient, and can be used to coat substrates having relatively low thermal limits.

Conventional wire arc spray devices use a gun having two converging and consumable wire electrodes. An arc is formed between the electrodes, resulting in molten material at the electrode tips which is stripped away and atomized by a carrier gas. The atomized coating material is then directed to a substrate for spray coating. A discussion of wire arc spraying may be found in; *Optical Diagnostics and Modeling of Gas and Droplet Flow in Wire Arc Spraying,* Kelkar et al., Proceedings of the $15^{th}$ International Thermal Spray Conference, pp. 329–334 (1998); and *Thermal Spray: New Technology is its Lifeblood,* Irving, Welding Journal, Vol. 77, no. 3, pp. 38–45 (1998).

In addition to twin-wire arc spray devices, some thermal spray systems produce a thermal spray with the use of a single-wire wherein the arc is typically formed with the spray nozzle. For instance, see *Recent Developments in Arc Spraying*, Steffens et al., IEEE Transactions on Plasma Science, Vol. 18, no. 6, pp. 974–979 (1990); and U.S. Pat. No. 3,064,114 (Cresswell et al.).

While these wire arc spray processes are effective, problems remain. For instance, devices that arc to the nozzle may result in erratic arc attachment. This may lead to inconsistent spray characteristics and possibly premature nozzle clogging.

Moreover, spray output generated by many nozzle arcing devices as well as by various twin-wire systems may rapidly diverge upon exiting the spray nozzle. In some devices, angular spray divergence of 20 degrees or more is not uncommon. In twin wire systems, divergence can at least partially be attributed to the different polarity of the two wires.

Spray divergence is undesirable for several reasons. For instance, divergence results in decreased flux density of the spray material as the spray expands. As flux density decreases, some degree of droplet solidification may occur during spraying, resulting in a porous and nonuniform coating. Divergence may also produce a spray coating having a nonuniform thickness, e.g., a coating that is noticeably thicker near the center of the spray pattern and thin and/or uneven near the outer edges. Still further, divergence of the sprayed material may also result in excessive dust and overspray (spray outside the intended target spray area). For at least these reasons, masking of the substrate, multiple spray passes, and subsequent surface finishing are often required to achieve coatings having a uniform thickness.

As a result of these issues, systems able to produce a more focused thermal spray pattern have emerged. For example, U.S. Pat. No. 4,370,538 (Browning) discloses a high velocity dual stream flame spraying system. While effective for its intended purpose, the '538 invention may not include benefits (e.g., low cost equipment, usable with thermally sensitive substrates) available with some wire arc spraying systems.

Other patents, see e.g., U.S. Pat. Nos. 4,492,337 (Harrington et al.) and 5,191,186 (Crapo III et al.), on the other hand, are directed to improvements to twin-wire spraying apparatus that yield higher quality coatings. While effective, these apparatus still utilize two consumable electrodes of opposite polarity. As a result, potential spray instabilities due to irregularities inherent in the process of simultaneously feeding two wires are possible.

SUMMARY OF THE INVENTION

The present invention is directed to single-wire arc spray apparatus and methods of use that yield a narrow beam spray, and thus a controlled width spray pattern, having highly defined edges. Apparatus and methods of the present invention furthermore produce such advantageous spray patterns without the problems commonly associated with other wire arc devices.

In one embodiment, a liquid material droplet generator is provided. The generator includes a gas nozzle having a nozzle entrance, a nozzle exit, and a nozzle bore where the nozzle bore defines a nozzle axis. A first consumable electrode is also included and is positionable within the nozzle bore of the gas nozzle. A second non-consumable electrode positionable outside the gas nozzle proximate the nozzle exit is also provided.

In another embodiment, a liquid material droplet generator is provided and includes means for forming a gas jet, wherein the means for forming the gas jet comprises a passageway having an exit. The generator further includes means for delivering a consumable feedstock to the exit and along an axis of the passageway, and means for establishing a heat zone outside of the passageway and adjacent the exit. The means for establishing the heat zone is adapted to melt at least a portion of the consumable feedstock to form liquid droplets.

In another embodiment, a liquid material droplet generating system is provided. The system includes a single-wire arc spray apparatus having a gas nozzle with a nozzle entrance, a nozzle exit, and a nozzle bore, the nozzle bore defining a nozzle axis. The spray apparatus further includes a first consumable electrode positionable within the nozzle bore, wherein the first consumable electrode has a first electrode axis, and a second non-consumable electrode positionable outside the gas nozzle proximate the nozzle exit. The system also includes a power supply apparatus adapted to connect to at least the first consumable electrode and the second non-consumable electrode, and a feeding apparatus adapted to feed the first consumable electrode through the nozzle bore. A controller adapted to control one or more of the power supply apparatus and the feeding apparatus may also be provided.

A method of generating a narrow beam thermal spray of liquid droplets is also provided. The method includes providing a gas nozzle having a nozzle entrance, a nozzle exit, and a nozzle bore, where the nozzle bore defines a nozzle axis. The method also includes positioning a first consumable electrode within the nozzle bore of the gas nozzle and positioning a second non-consumable electrode outside of the gas nozzle proximate the nozzle exit. An electrical arc may be formed outside of the gas nozzle proximate the nozzle exit, where the electrical arc is formed between a terminal end of the first consumable electrode and a portion of the second non-consumable electrode.

In yet another embodiment of the present invention, a method for forming a high density microstructure is provided. The method may include providing a gas nozzle having a nozzle entrance, a nozzle exit, and a nozzle bore, where the nozzle bore defines a nozzle axis. The method may also include positioning a first consumable electrode within the nozzle bore of the gas nozzle and positioning a second electrode outside of the gas nozzle and proximate the nozzle exit. A first arc gas may be accelerated through the gas nozzle to form a gas jet at the nozzle exit. An electrical arc may be formed outside of the gas nozzle proximate the nozzle exit, where the electrical arc is formed between a terminal end of the first consumable electrode and a portion of the second electrode. The electrical arc causes a portion of the first consumable electrode to melt and form droplets near a center of the gas jet, forming a narrow beam thermal spray. The method may also include depositing the droplets on a substrate surface to form a coating, where the coating is defined by substantially indiscernible boundaries between the droplets that form the coating.

The above summary of the invention is not intended to describe each embodiment or every implementation of the present invention. Rather, a more complete understanding of the invention will become apparent and appreciated by reference to the following detailed description and claims in view of the accompanying drawings.

BRIEF DESCRIPTION OF THE DRAWINGS

The present invention will be further described with reference to the drawings, wherein.

DETAILED DESCRIPTION OF EXEMPLARY EMBODIMENTS

In the following detailed description of exemplary embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

As used herein, the phrase "narrow beam" or "narrow beam spray" defines a focused, e.g., concentrated, droplet spray having an angle of divergence, e.g., amount of "spreading" of the droplets within the spray, of 10 degrees or less. The phrase "high definition spray pattern" defines a spray pattern produced when such a narrow beam spray is used to coat a substrate surface, i.e., a high definition spray pattern may result when a narrow beam spray coats a substrate. The phrase "angle of divergence" or "divergence angle" defines the planar angle measured between an imaginary line generally defining the peripheral edge of the narrow beam spray and a second line parallel to the centerline of the spray.

Figure 2A:
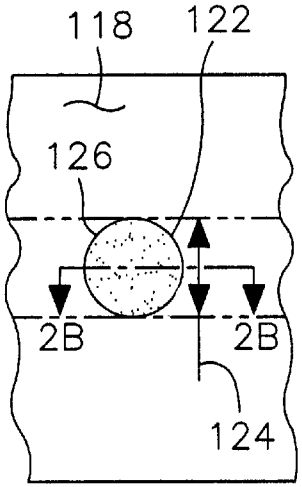
FIG. 2A is a plan view of a substrate surface illustrating a high definition spray pattern produced by the spray apparatus of FIG. 1.
Figure 2B:
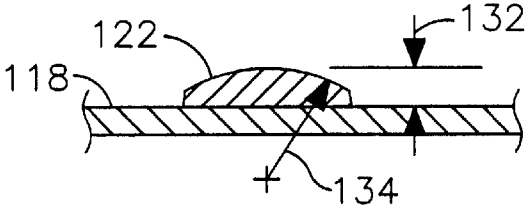
FIG. 2B is a section view taken along line 2B—2B of the high definition spray pattern of FIG. 2A.

The phrase "aspect ratio," as used herein, refers to the height or thickness 132 of the resulting spray pattern relative to its width 124 as generally shown in FIGS. 2A and 2B. "Radius of curvature" refers to the magnitude of the radius 134 of the resulting spray pattern.

The phrase "high density microstructure" refers to a coating structure produced by a single-wire arc thermal spray process wherein the coating is characterized by substantially indiscernible boundaries between the individual droplets used to form the coating. That is, a coating produced by a high degree of molten droplet interaction, as well as reduced oxidation, prior to droplet solidification. "Coating" is used to refer to at least one layer formed by a plurality of liquid droplets after the droplets solidify.

The term "gas nozzle" is used herein to indicate a nozzle structure adapted to produce a gas jet by accelerating one or more gases through the nozzle. Such a nozzle structure produces a gas jet originating at the gas nozzle exit.

Broadly speaking, the present invention is directed to liquid material droplet generators for producing a narrow beam thermal spray of liquid droplets which may be used to apply high definition spray patterns. These sprays are useful in a variety of applications including but not limited to: spraying of engine valve seats and pipe seams, wear surface formation, dimensional restoration, and fabrication of freestanding, rapid prototyping structures.

Figure 1:
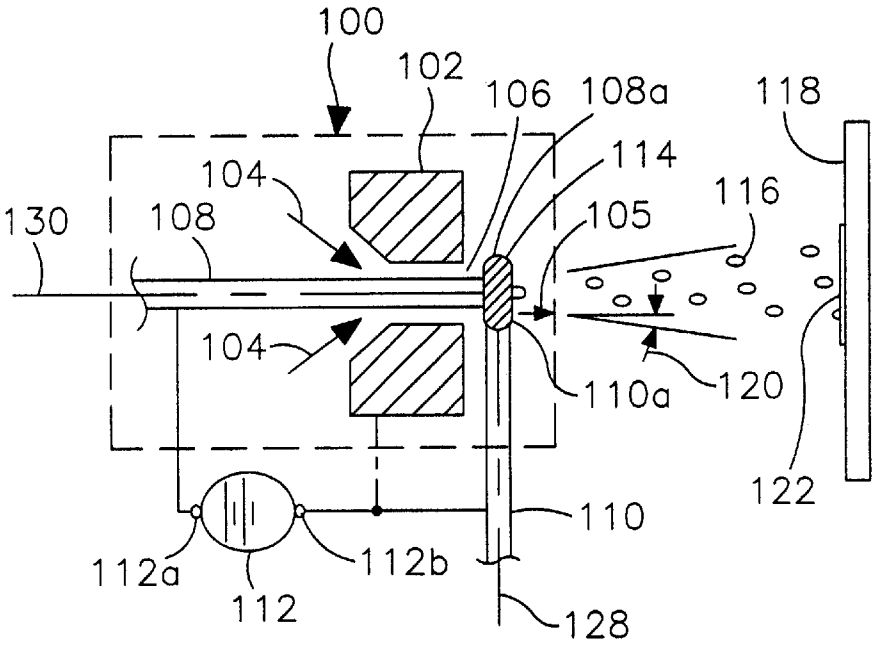
FIG. 1 is a diagrammatic view of a droplet generator, e.g., a single-wire arc spray apparatus, in accordance with one embodiment of the invention.

To produce such focused sprays, droplet generators of the present invention may utilize a single-wire (e.g., having a single consumable wire) arc thermal spray apparatus 100 of which one embodiment is diagrammatically depicted in FIG. 1. The apparatus 100 may include a gas nozzle 102 for directing a carrier or arc gas in the direction generally indicated by arrows 104. A first electrode 108 may be located generally along an axis 130 of the nozzle 102 within the nozzle bore. As FIG. 1 illustrates, the first electrode 108 may also extend through the nozzle bore at least to a nozzle exit 106.

A second electrode 110 may be located outside the gas nozzle 102 and proximate the nozzle exit 106. The second electrode 110, unlike some devices that arc to the nozzle, is preferably configured to provide at least one controllable and predetermined, e.g., preferred, arc attachment point. While there are various configurations within the scope of the invention that may provide such a desired arc attachment point, embodiments described and illustrated herein are directed to a second electrode 110 having at least a terminal or end portion that forms a second electrode axis 128 substantially perpendicular to the axis 130 of the nozzle 102. While not illustrated in this figure, an axis (not shown) of the first electrode 108 may be skewed relative to the axis 130 of the nozzle 102 as further described below with respect to FIGS. 3–5 and 7.

Other embodiments wherein the axis 128 of at least a portion of the second electrode 110 forms an acute angle with the axis 130 are also possible. Moreover, other embodiments that utilize a non-linear second electrode 110, e.g., a point electrode, are also possible within the scope of the invention.

A power source or supply 112 having its first, e.g., positive, terminal 112*a* coupled to the first electrode 108 and its second, e.g., negative, terminal 112*b* coupled to the second electrode 110 may also be provided. In some embodiments, the power supply is preferably a direct current (DC) power supply providing either a continuous direct current or a pulsed direct current, the latter providing alternating current levels between a first, or maximum, current level and a second, or minimum, current level. While the nozzle 102 is, in one embodiment, electrically neutral, it may optionally be connected to the second terminal of the power supply 112 as shown by the broken line connection in FIG. 1.

When the power supply 112 and arc gas source (not shown) are activated, a heat zone, which, in one embodiment, is created by an electrical arc 114, is formed between a tip 108*a* of the first electrode 108 and a tip 110*a* of the second electrode 110. The heat zone is located downstream from, e.g., beyond, the nozzle 102 proximate the nozzle exit 106. Preferably, the first electrode 108 is a consumable wire such that the heat zone, (arc 114) melts at least a portion of the tip 108*a* to generate molten droplets 116. To avoid the problems associated with twin-wire systems, it is further preferred that the second electrode 110 be non-consumable.

As the arc gas is accelerated through the nozzle 102, a freely-expanding gas jet 105 is formed at the exit 106 of the nozzle 102. The droplets 116, formed near a center of the expanding gas jet 105, may be detached from the molten tip 108*a* of the first electrode 108 by the gas jet 105 where they are then accelerated generally along an axis of the gas jet 105. A general discussion of forces acting on liquid droplets is provided in *High Definition Single Wire Arc Spray,* Carlson et al., International Thermal Spray Conference 2000, Montreal, Calif., ASM International, pp. 709–716 (2000), and in more detail in *A Dynamic Model of Drops Detaching from a Gas Metal Arc Welding Electrode,* Jones et al., J. Physics D: Appl. Phys. 31, pp. 107–123 (1998).

The droplets 116, now entrained generally along the axis of the gas jet, form a narrow beam droplet spray which may be directed to a substrate surface 118 located downstream from the nozzle exit 106. In accordance with the present invention, the narrow beam droplet spray may diverge at an angle 120 (angle shown enlarged for clarity), although the freely expanding gas jet 105 itself may diverge at an angle greater than the angle 120. To provide adequate spray, the first electrode 108 may be delivered at a feed rate which corresponds to the desired production of droplets 116. Further, the electric current delivered to the arc 114 by the power supply 112 may be adjusted to correspond to the desired feed rate.

As the droplets 116 contact the substrate surface 118, they cool and solidify, forming a coating 122 thereon. As illustrated in FIG. 2A, the apparatus 100 produces a coating 122 having a controllable, e.g., uniform, thickness and highly-defined edges 126 which define a spray width 124. Moreover, because the spray from the apparatus 100 is focused, overspray and dusting are substantially decreased, reducing or even eliminating the need for masking and/or subsequent surface treatment.

FIG. 2B illustrates a cross-section of the coating 122 of FIG. 2A. As illustrated herein, the single pass aspect ratio H:W (coating height 132 : coating width 124) may be in the range of 1:0.5 to 1:10 and the radius of curvature 134 may be equal to R, where R is one half the coating width 124 (wherein the cross-section shown in FIG. 2B is generally semicircular, e.g., having an aspect ratio of 1:2) or greater (e.g., wherein the cross-section shown in FIG. 2B approaches a generally rectangular shape).

With this brief introduction, exemplary embodiments of single-wire arc spray apparatus and methods will now be described.

Single-Wire Arc Spray Apparatur and Methods

Figure 3:
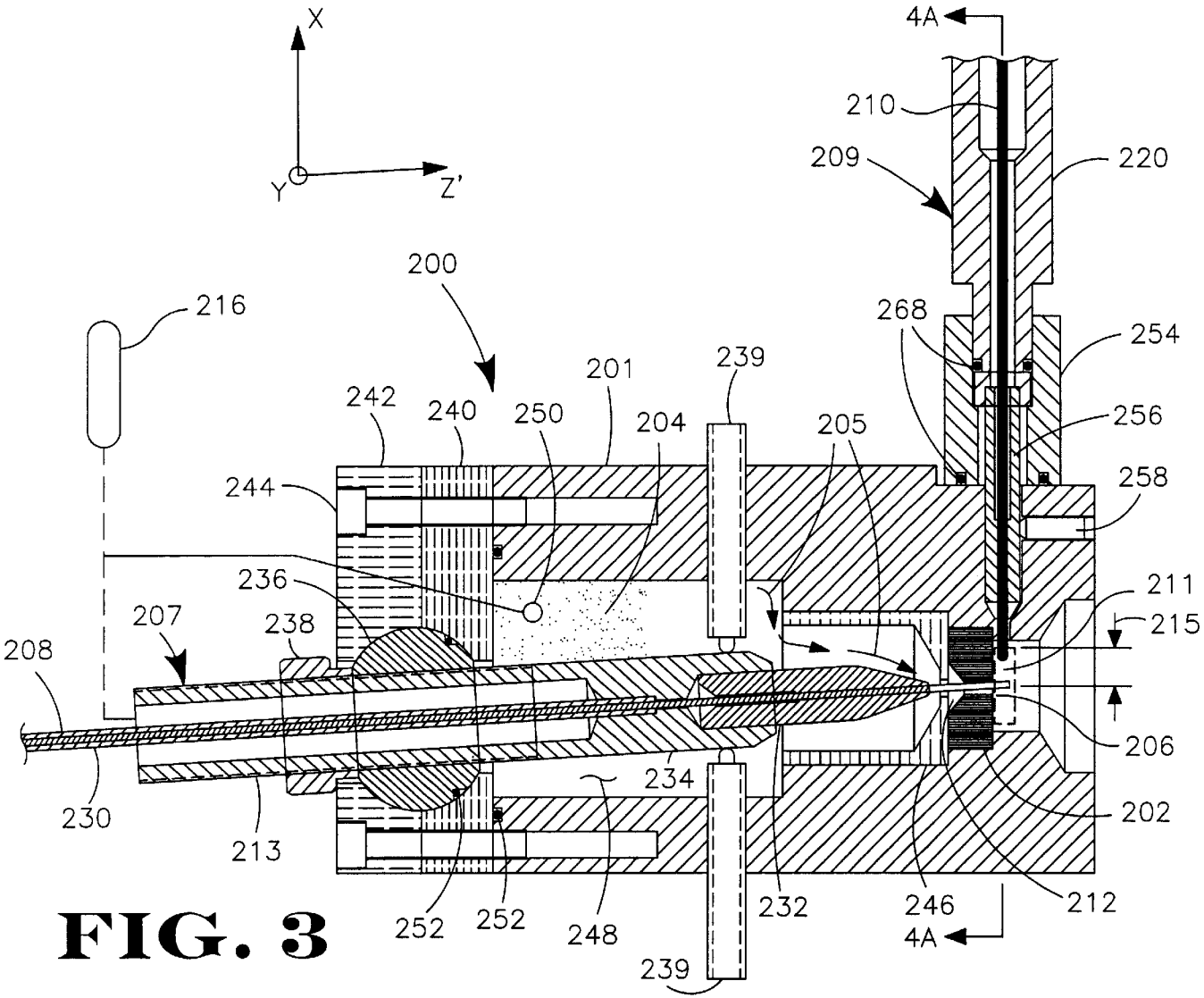
FIG. 3 is an enlarged cross-sectional view of a wire arc spray apparatus in accordance with another embodiment of the invention.

FIG. 3 illustrates a detailed, cross-section of a single-wire arc spray apparatus 200 similar in most respects to the apparatus 100 diagrammatically illustrated in FIG. 1. Once again, the embodiments described and illustrated herein are exemplary only. Other configurations are certainly possible without departing from the scope of the invention.

As FIG. 3 illustrates, the apparatus 200 may include a housing 201 for securing a first electrode assembly 207 and a second electrode assembly 209 relative to a first or gas nozzle 202. The first electrode assembly 207 may include a body 213 for protecting and supporting a first wire electrode 208 while the second electrode assembly 209 may include a body 220 for protecting and supporting a second electrode 210. While not limited to any one particular configuration, the second electrode 210 is illustrated herein as at least one wire electrode which may be located outside the nozzle 202 adjacent a nozzle exit 206. To further protect the first wire electrode 208, the first electrode assembly 207 may also include a wire sleeve or sheath 230.

Like the apparatus 100 discussed above, the first wire electrode 208 is preferably a consumable feedstock, made from conducting materials fed from an spool (not shown). Almost any electrode material is acceptable. For instance, either a solid electrode or a composite, e.g., a malleable hollow tube of metallic material having a metallic or non-metallic filler material therein, may be used. The second electrode 210, on the other hand, is preferably made from a non-consumable material such that coordinated feeding of the latter is not required. In one embodiment, the second electrode 210 may be made from a refractory metal, e.g., tungsten.

The body 213 may be adapted to deliver the first wire electrode 208 to an arc zone 211 downstream from the gas nozzle 202 adjacent the nozzle exit 206. In the illustrated embodiments, the first wire electrode 210 is positionable within a passageway or nozzle bore 278 (see FIG. 5). To further support the first wire electrode 208 proximate the gas nozzle 202, a contact tip 232, which in one embodiment is made of a ceramic material, may be used. More preferably, the contact tip is made from a metal such as copper. The contact tip 232 may couple to the body 213 via a contact tip support member 234 as illustrated. The contact tip support member 234 may form an integral portion to the body 213 or may be a separate component which couples thereto.

While not limited thereto, the gas nozzle 202, in one embodiment, may be made from a refractory metal (or ceramic) material. The nozzle bore 278 (see FIG. 5) may be formed by at least a constant diameter portion 224. The nozzle bore 278 may further include a conical portion 222 (see FIG. 5) formed at a nozzle entrance 212.

As FIG. 3 illustrates, the apparatus 200 may optionally include one or more components that permit adjustment of the first wire electrode 208 relative to the gas nozzle 202. For example, a ball swivel 236 (shown as threadably engaged with the body 213) may be provided to permit angular positioning of the first wire electrode 208 relative to the bore 278 (see FIG. 5) of the gas nozzle 202. In conjunction therewith, a lock nut 238 may permit axial displacement and immobilization of the body 213 relative to the ball swivel 236. For purposes of this description, the axis of the first wire electrode 208 may be identified as Z' (non-perpendicular to the X-Y plane) as shown in FIG. 3. Backing plates 240 and 242 may be used to secure the ball swivel 236, and thus the first electrode assembly 207, to the housing 201 with fasteners 244 or the like.

While not illustrated, the backing plates 240 and 242 may also permit X (e.g., up and down in FIG. 3) and Y (e.g., perpendicular to the view of FIG. 3 and up and down in FIG. 4) motion of the ball swivel 236 (and thus the first electrode assembly 207) relative to the housing 201. For example, the fasteners 244 may pass through slotted openings in the backing plates 240 and 242, allowing adjustment of the ball swivel 236 via movement of the plates 240 and 242. Alternatively, use of backing plates 240 and 242 of different dimensions/configurations may allow repositioning of the ball swivel 236 relative to the housing 201.

Positioning members, e.g., threaded set screws 239, may also be provided to more precisely locate the electrode assembly 207, e.g., the first wire electrode 208, relative to the gas nozzle 202. The advantages of such precise location of the first wire electrode 208 are explained in more detail below.

Accordingly, some embodiments of the apparatus 200 allow the first wire electrode 208 not only to pivot with the ball swivel 236, but also to move in the X and Y directions as well. Other embodiments, on the other hand, may fix the location of the first wire electrode 208 relative to the gas nozzle 202. In still other embodiments, dynamic control of the position of the first wire electrode 208 relative to the gas nozzle 202 may be provided. For example, a positioning apparatus coupled to a closed loop control system (not shown) may actively adjust the location, e.g., angular, X, and/or Y position of the first electrode assembly 207 relative to the nozzle bore 278, before and/or during operation.

As discussed above, the contact tip 232 advantageously positions the first wire electrode 208 through the bore 278 of the gas nozzle 202 as shown in FIG. 3. To reduce or eliminate secondary arcing of the first wire electrode 208 with the gas nozzle 202 during operation, a second nozzle, e.g., an electrically insulating nozzle 246, may be located adjacent to or proximate the nozzle entrance 212 of the gas nozzle 202. While most any electrically insulating material will suffice, the insulating nozzle 246 may, in one embodiment, be made from a refractory material such as ceramic, aluminum oxide, or alumina.

The interior shape, e.g., bore, of the insulating nozzle 246 as well as that of the gas nozzle 202 is selected to generate the desired flow, e.g., flow in the direction indicated by arrows 205, of an arc gas 204 without introducing undesirable flow disturbances. While not limited to specific configurations, the nozzle bore 278 of the gas nozzle 202 preferably includes both the conical portion 222 and the constant diameter portion 224 as described above and shown in the figures (see e.g., FIG. 5).

The arc gas 204 itself may be introduced into the apparatus 200 in any one of a number of ways that generate the desired flow. For instance, one or more ports 250 (see FIG. 3) may permit introduction of the arc gas 204 from a gas source 216 into a cavity 248 formed within the housing 201. Alternatively, the arc gas may be introduced through the first electrode assembly 207, e.g., through the space between the sheath 230 and the body 213, as illustrated in the broken line connection to the gas source 216 in FIG. 3. Seals 252, e.g., O-rings, may be used to prevent leakage of the arc gas 204 through component interfaces.

Figures 4A, 4B:
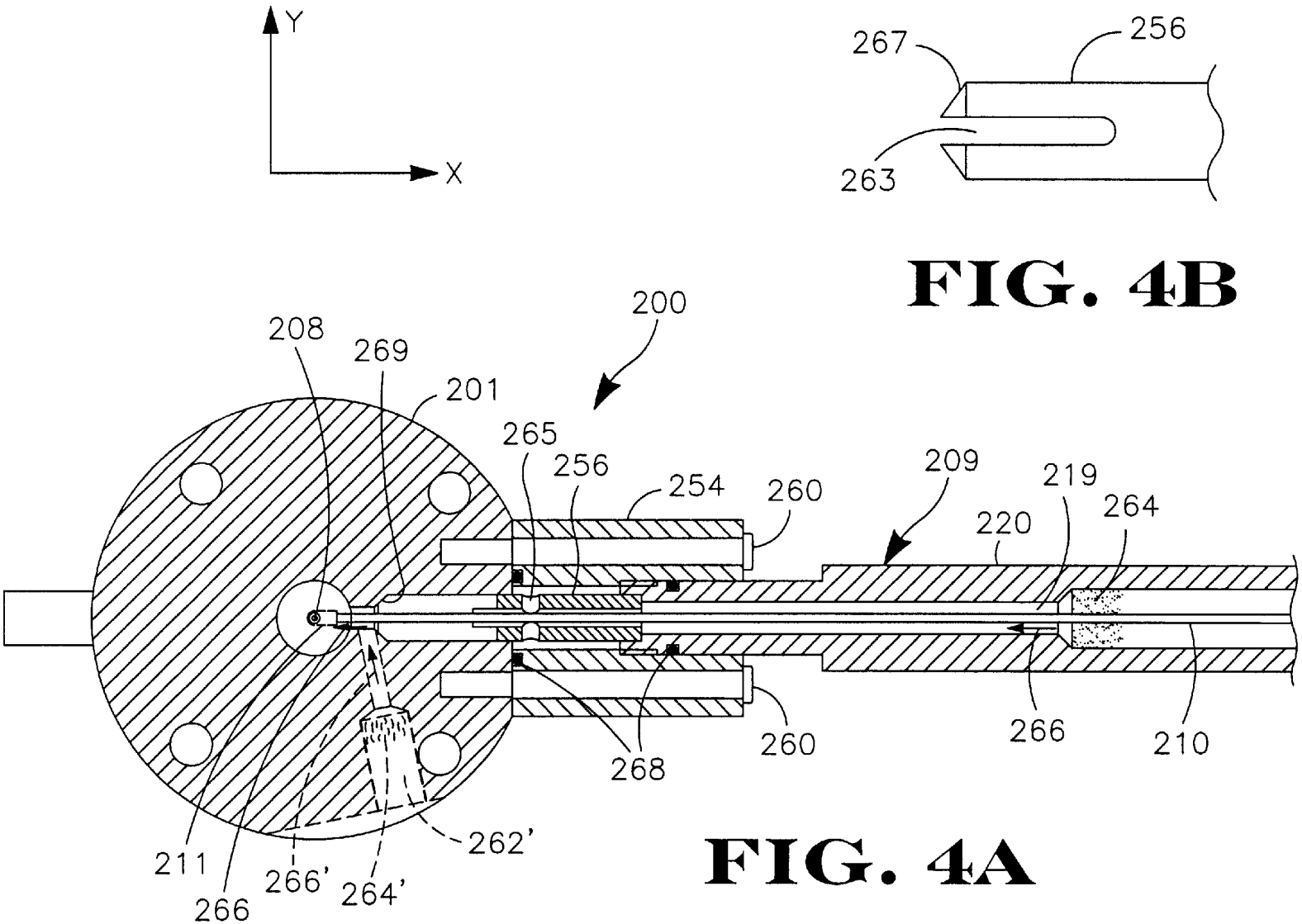
FIG. 4A is a cross-sectional view taken along line 4A—4A of FIG. 3.
FIG. 4B is a enlarged, partial view of an electrode collet of FIG. 4A.

FIG. 4A illustrates the coupling of the second electrode assembly 209 to the housing 201. The position and configuration of the second electrode 210 is adapted to provide a known and controllable arc attachment point. While various electrode configurations are possible, the apparatus and methods described and illustrated herein are, for the sake of brevity, directed to an embodiment in which at least a terminal portion of the second electrode 210 has an axis 228 oriented substantially perpendicular to an axis 274 of the gas nozzle 202 (see FIG. 5), e.g., the second electrode 210 is configured as a straight wire electrode. However, other configurations such as those having non-perpendicular orientations between the axis 228 and the axis 274, as well as those having non-wire configurations of the second electrode are also possible. Furthermore, configurations having multiple second electrodes, e.g., at different radial positions, are also possible.

To couple the body 220 of the second electrode assembly 209 to the housing 201, the body may threadably engage a coupling member 254. In turn, the coupling member 254 may fasten to the housing 201 via fasteners 260 or the like.

An electrode collet 256 may also be included. In one embodiment, the electrode collet 256 includes a tapered surface (see surface 267 in FIG. 4B) which engages a mating tapered surface 269 of the housing 201 (see FIG. 4A). By threading the body 220 into the coupling member 254, the electrode collet 256 may be securely retained between the body 220 and the tapered surface 269 of the housing 201 as generally shown in FIG. 4A. To further retain the electrode collet 256, e.g., prevent rotation of the electrode collet 256 relative to the housing 201, a registration member, e.g., set screw 258 shown in FIG. 3, may also be used.

FIG. 4A further illustrates various constructions for introducing a second, shield or shroud gas 264 associated with the second electrode 210. In one embodiment, a channel 219 through which the second electrode 210 passes may permit the flow of shroud gas 264 in the direction 266 to deliver it to the second electrode 210 proximate the arc zone 211. The electrode collet 256 may include one or more cross-drilled holes 265 to permit the flow of shroud gas 264 outside of the collet 256.

To further improve shroud gas 264 flow, the electrode collet 256 may also include one or more longitudinal slots 263, e.g., two diametrically opposed slots, as shown in FIG. 4B. The slots 263 permit shroud gas to flow past the interface between the tapered surfaces 267 of the electrode collet 256 and the tapered surface 269 of the housing 201 (see FIG. 4A). The slots 263 also permit deformation of the electrode collet 256 as the latter is loaded against the tapered surface 269.

In an alternative embodiment illustrated in broken lines in FIG. 4A, one or more passageways 262' may be used to introduce the shroud gas 264' in the direction 266' to the second electrode 210 proximate the arc zone 211.

The shroud gas 264 may surround the second electrode 210 in the vicinity of the arc zone 211 and protect it from oxidation and contamination during operation. Preferably, the shroud gas 264, like the arc gas, is an inert or non-oxidizing gas such as argon or nitrogen. As the shroud gas 264 is introduced, it preferably flows in the direction indicated by arrows 266 towards the second electrode 210. The shroud gas 264 generally envelopes the second electrode 210 in the vicinity of the arc zone 211, protecting the second electrode 210 from premature oxidation or contamination. Seals, e.g., O-rings 268, prevent the shroud gas 264 from escaping back through component interfaces of the second electrode assembly 209.

Figure 5:
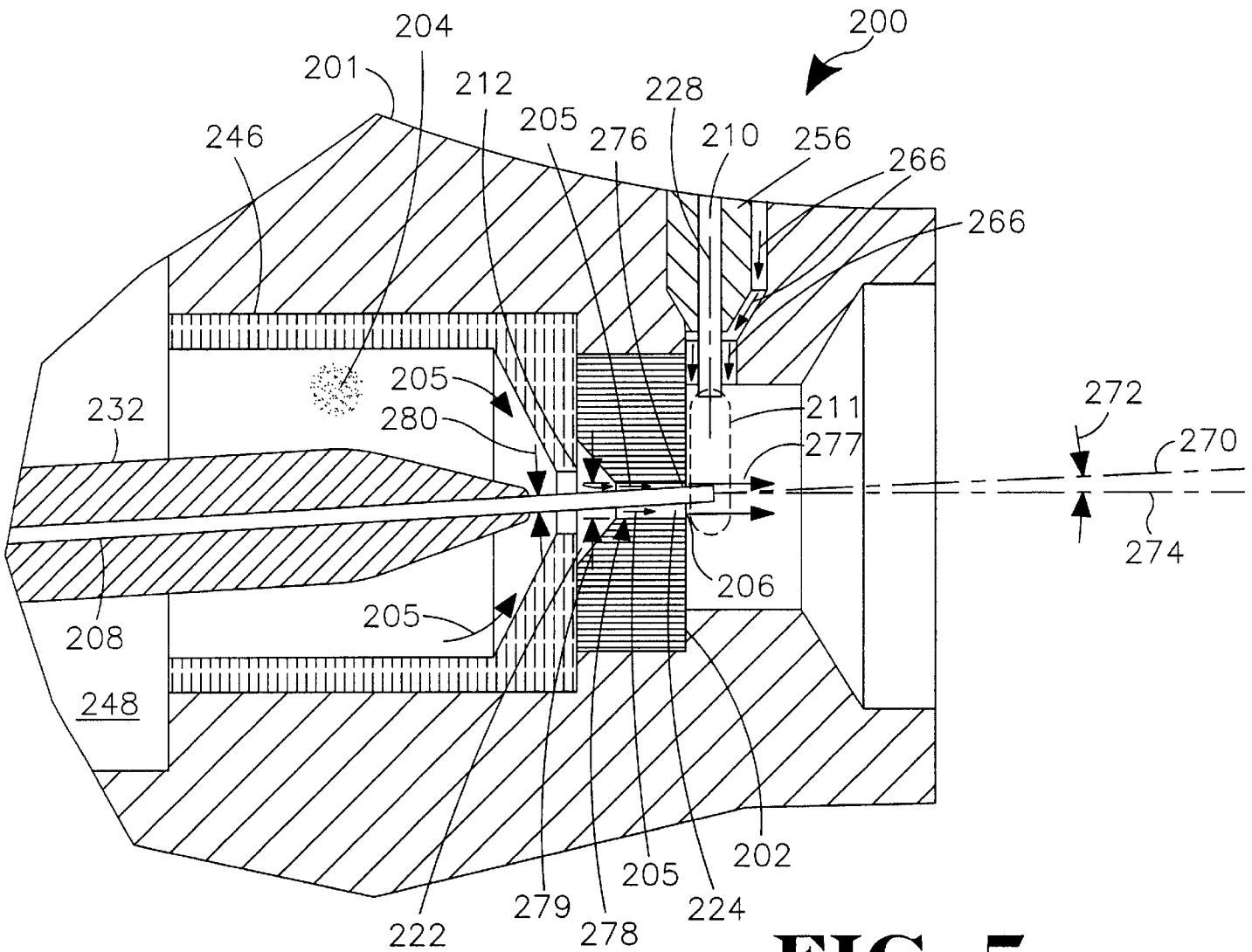
FIG. 5 is an enlarged cross-sectional view of a portion of the apparatus of FIG. 3.

FIG. 5 illustrates an enlarged view of a portion of the apparatus 200 of FIG. 3. Once again, the housing 201, insulating nozzle 246, and gas nozzle 202 are clearly shown as are the first wire electrode 208 extending from the contact tip 232 through the nozzle bore 278, and the second electrode 210 extending from the electrode collet 256. The flow direction of the shroud gas is indicated by arrows 266 while the flow direction of the arc gas 204 is indicated by arrows 205. The first electrode assembly 207 may be positioned such that a first electrode axis 270 of the first wire electrode 208 forms an angle 272 with the nozzle axis 274 defined by the nozzle bore 278. Those of skill in the art will realize that the axis 272 of the first electrode 208 may not necessarily be coplanar with the axis 274 of the arc nozzle 202, e.g., one may be skewed with respect to the other. In these instances, it is understood that the angle 272 indicates the angle between the two axes when the axes are moved parallel to themselves to a common point of intersection.

Furthermore, the second electrode assembly 209 may be positioned such that at least a terminal portion of the second electrode 210 has the second electrode axis 228 substantially perpendicular with the nozzle axis 274.

Once again, the electrode configuration described herein is exemplary only and other configurations are certainly possible without departing from the scope of the invention.

Although not exclusively limited thereto, the angle 272 may be 5 degrees or less and, more preferably, from 1 degree to 3 degrees. In some embodiments, arc starting was enhanced as the angle 272 was increased from 0 to 3 degrees. Yet, when the angle 272 was increased beyond 3 degrees, no significant further improvement was observed. Further, when the angle 272 was less than 1 degree or greater than 4 degrees, secondary arcing at the nozzle entrance 212 was observed. Moreover, angular divergence of the resultant spray appeared to be minimized when the angle 272 was 2 degrees to 3 degrees. While having an effect on secondary arcing at arc initiation, the importance of the angle 272, at least as it relates to secondary arcing, appeared to diminish during operation.

To accommodate the angular orientation of the first wire electrode 208 relative to the nozzle axis 274, the constant diameter portion 224 of the nozzle bore 278 may have a diameter 279 of 2 to 3 times a diameter 280 of the first wire electrode 208 and, more preferably, 2.5 times the diameter 280. Of course, other bore sizes and shapes are certainly possible without departing from the scope of the invention.

As the arc gas 204 exits the cavity 248, it travels in the direction indicated by arrows 205 (see FIG. 5). The arc gas then accelerates as it travels through the gas nozzle 202, producing a gas jet originating at the nozzle exit 206. The gas jet generally flows in the direction indicated by arrows 277. As described above, during operation, the gas jet carries the spray material to a substrate surface for coating.

Figure 6:
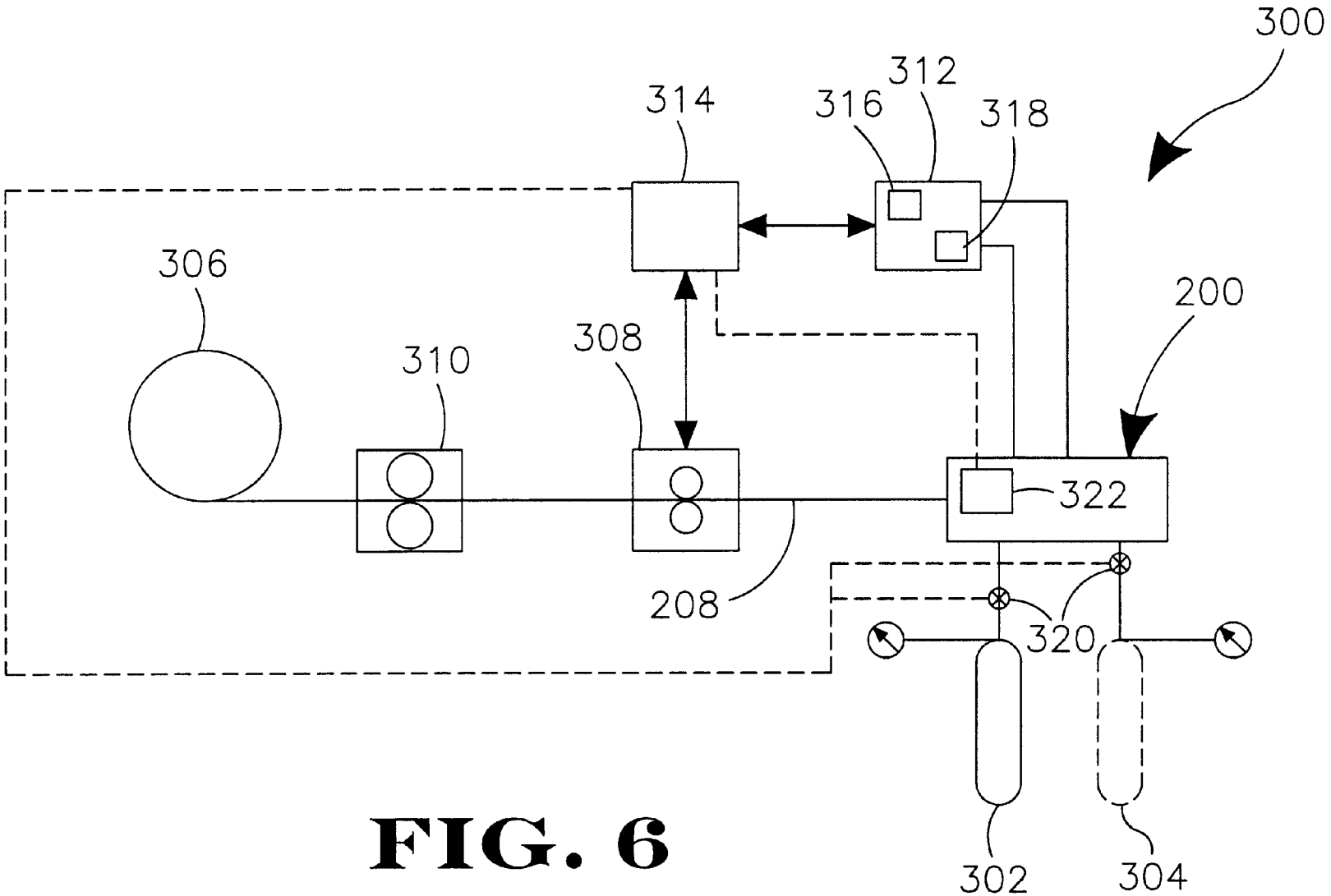
FIG. 6 is a diagrammatic view of a liquid material droplet generating system in accordance with one embodiment of the invention.

FIG. 6 illustrates a liquid material droplet generating system 300 in accordance with one embodiment of the invention. The system incorporates an exemplary single-wire arc spray apparatus 200. The system 300 further includes a first or arc gas source 302 for delivering the arc gas to the apparatus 200 and a second or shroud gas source 304 for delivering the shroud gas associated with the second electrode 210 to the apparatus 200. In some embodiments, the arc gas and the shroud gas may be identical such that only a single gas source, e.g., source 302, may be required. In this case, valves may be used to allow independent control of pressure/flow for both the arc gas and the shroud gas.

A wire supply 306 may also be included to provide a consumable spool of the first wire electrode 208. To control the feed rate of the first wire electrode 208, a feeding apparatus 308 may also be included. Optionally, a wire straightener 310 may be used to straighten the first wire electrode 208, preferably before passing through the feeding apparatus 308.

A power supply apparatus 312 may also be provided. In one embodiment, the power supply apparatus 312 may include a DC power source 316 adequate to produce the desired arc current necessary to melt the consumable first wire electrode 208. The DC power source 316 may provide a continuous current or a pulsating current as described above. The apparatus 312 may also include a high frequency arc starting unit 318 for initiating the electrical arc between the first consumable electrode 208 and the second electrode 210 (see FIGS. 3–5). To control the wire feed rate relative to the arc current, a controller 314 may also be provided. Other components not considered critical to an understanding of the present invention, while not specifically addressed herein, may also be included.

During operation, the arc starting unit 318 may initiate the arc starting process. In some embodiments, it may be advantageous to initiate arcing, at least in part, by arcing between the first wire electrode 208 and the gas nozzle 202 (see FIG. 5). Once the arc is formed, it may transfer from the gas nozzle 202 to the second electrode 210. The DC power source 316 may then deliver current sufficient to maintain arcing between the first wire electrode 208 and the second electrode 210 in the arc zone 211 (see FIG. 5).

The angle 272 between the axis 270 of the first wire electrode 208 and the nozzle axis 274 (see FIG. 5) may be adjusted before or during operation as described above. Depending on numerous parameters, e.g., the material to be sprayed, the temperature of the spray, and the spray delivery rate, the controller 314 (see FIG. 6) may adjust the feed rate of the first wire electrode 208, e.g., adjust the feeding apparatus 308, as well as adjust the power, e.g., electrical current, delivered by the DC power source 316. Similarly, the controller 314 may provide input to an electrode positioning apparatus 322 to dynamically control the position of the first wire electrode 208 relative to the gas nozzle 202. Where beneficial, the controller 314 may also control gas valves 320 to control the flow and/or pressure of the arc gas supply 302 and/or the shroud gas supply 304.

Figure 7:
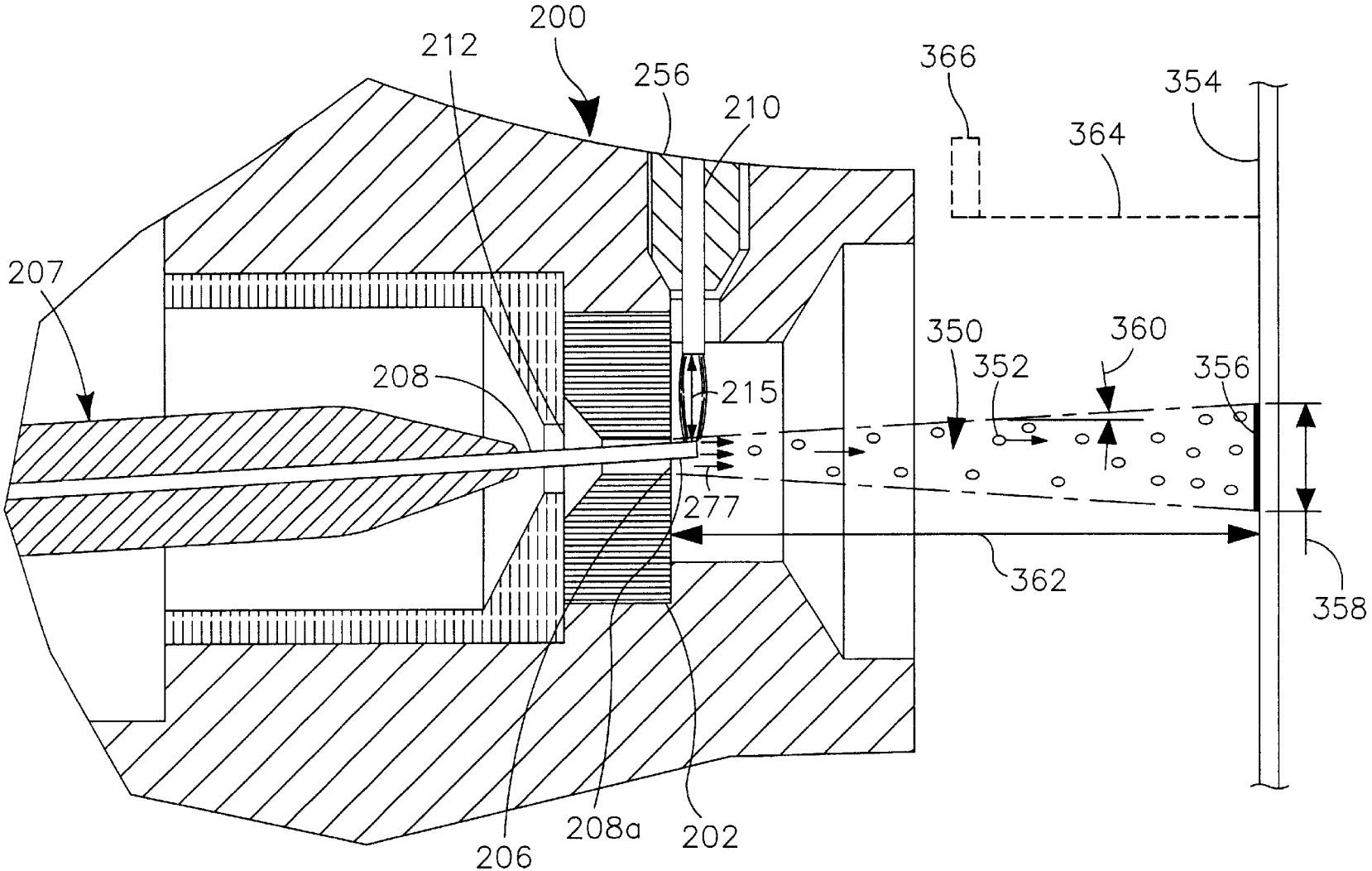
FIG. 7 is an enlarged cross-sectional view of a portion of the apparatus of FIG. 3 illustrating a narrow beam spray and corresponding high definition spray pattern.

The apparatus 200 may produce a droplet spray 350 consisting of droplets 352 of material stripped from a terminal end or tip 208*a* of the first wire electrode 208 as shown in FIG. 7. The molten droplets 352 are carried by the gas jet exiting the gas nozzle 202 in the direction indicated by arrows 277. The gas jet may deliver the droplets 352 to a substrate surface 354 for forming a coating 356 thereon. In accordance with the present invention, the spray 350 has a small angle of divergence 360 such that it forms a narrow beam thermal spray of liquid droplets useful for producing a highly defined spray pattern, e.g., a pattern having a consistent width 358 dependent upon a distance 362 between the nozzle exit 206 and the substrate surface 354.

The narrow beam spray is characterized by the small angle of divergence 360. As discussed above, embodiments of the apparatus 200 in accordance with the present invention may yield an angle of divergence 360 of the spray 350 of 10 degrees or less and preferably 5 degrees or less. Still more preferably, embodiments of the apparatus 200 in accordance with the present invention may yield an angle of divergence 360 of 2 degrees or less or, even more preferably, 1 degree or less. While the narrow beam spray 350 produced has a minimal angle of divergence 360, the freely-expanding gas jet, indicated by arrows 277, may itself expand to a greater degree.

Apparatus and methods of the present invention may also yield a gas jet and spray 350 (see FIG. 7) having an axis (not shown) slightly misaligned or skewed from the axis 274 of the nozzle 202 (See FIG. 5). This may be attributed to several factors, including arc zone effects and the orientation of the first wire electrode 208 within the nozzle 202.

To control the spray process, various parameters may be adjusted. For example, adjusting of the arc gas/gas jet flow rate (adjustable, for example, by varying the arc gas back pressure within the cavity 248 of FIG. 3) may permit changes in droplet size, droplet initial velocity, droplet temperature, and droplet trajectory. Similarly, these variables may also be influenced by adjusting the arc current, altering the first wire electrode position relative to the gas nozzle, or altering the first electrode material. Other parameters, e.g., first electrode feed rate, shroud gas flow rate, first electrode diameter, may also affect spray characteristics.

EXAMPLES

Experiments were carried out using an apparatus 200 as generally shown in FIGS. 3–5 and 7. While the actual control parameters may vary, in some embodiments, apparatus 200 were configured in accordance with the parameters of Table I below.

TABLE I

| | |
|---|---|
| Cavity back pressure: | 20–60 psia (1.3–4.1 atmospheres) |
| Arc gas: | Argon |
| First wire electrode diameter: | 0.023–0.030 inches (0.58–0.76 millimeters) |
| First wire electrode classification: | ER70S (ESAB brand Easy Grind) |
| Wire feed rate: | 9.8–27.6 feet/minute (3.0–8.4 meters/min) |
| Arc current: | 35–130 Amps |
| Arc voltage: | 19–25 Volts |

TABLE I-continued

| | |
|---|---|
| Gas nozzle material: | Tungsten |
| Gas nozzle bore diameter (reference numeral 279 in FIG. 5); generally 2–3 times the first wire electrode diameter: | 0.046–0.090 inches (1.1–2.3 mm) |
| Second electrode material: | Tungsten + 2% Thorium |
| Second electrode diameter: | 0.040 inches (1.0 mm) |
| Shroud gas: | Argon |
| Shroud gas flow rate: | 0.35–0.57 standard cubic feet/min (10–16 standard liters/min) |
| First wire electrode angle (reference numeral 272 in FIG. 5): | Less than 5 degrees |
| Distance from tip of first electrode to tip of second electrode (reference numeral 215 in FIG. 7): | 0.016–0.16 inches (0.40–4.0 mm) |
| Nozzle-to-substrate distance (reference numeral 362 in FIG. 7): | 2.0 inches (51 mm) |
| Substrate material: | Grit-blasted aluminum |

When experiments were run utilizing apparatus and methods in accordance with these parameters, the average angle of divergence 360 (see FIG. 7) was 2.5 degrees. The average deposition efficiency (e.g., amount of material deposited versus the amount of electrode material melted) was 78% for a 0.023 inch (0.584 mm) diameter wire and 84% for a 0.030 inch (0.762 mm) diameter wire. Similarly, the maximum deposition rate was 0.034 lb/min. (0.26 g/sec) for the 0.023 inch (0.584 mm) diameter wire and 0.057 lb/min.(0.43 g/sec) for the 0.030 inch (0.762 mm) diameter wire. The average droplet mass mean diameter was 344 microns and 352 microns for the 0.023 inch (0.584 mm) and the 0.030 inch (0.762 mm) diameter wire, respectively.

Figure 8:
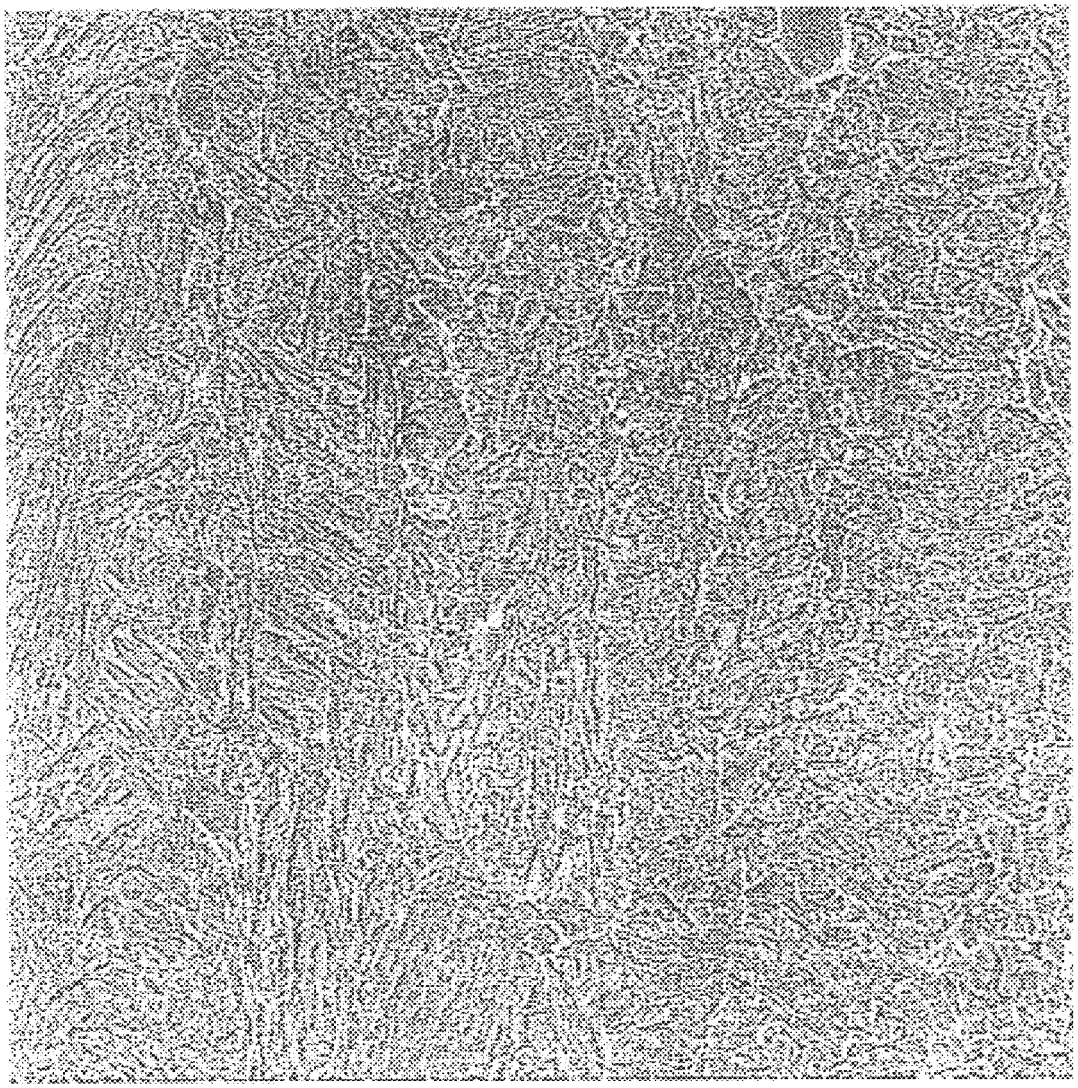
FIG. 8 is a SEM photograph illustrating a partial cross-sectional view of a coating microstructure applied by a wire arc spray apparatus in accordance with one embodiment of the present invention.
Figure 9:
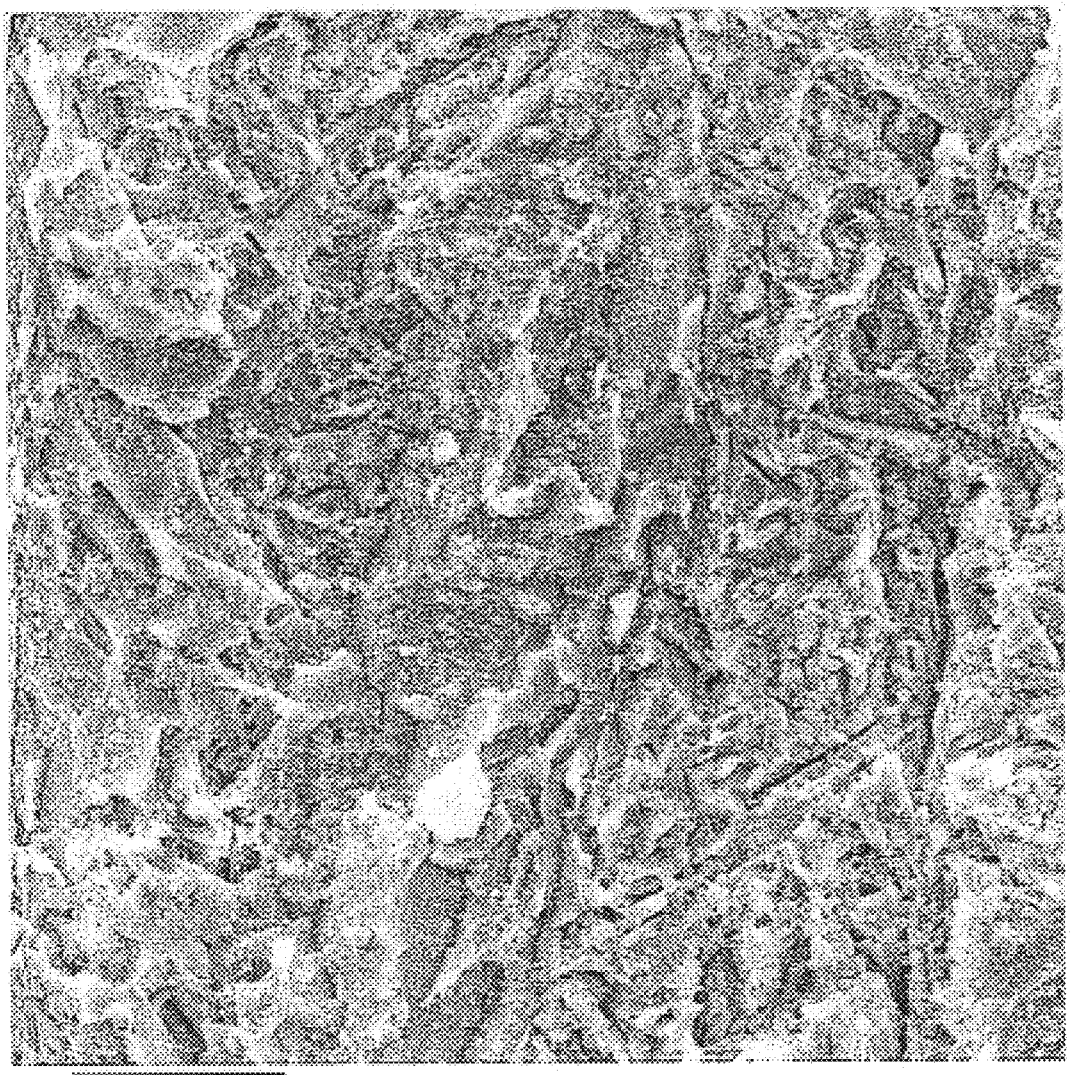
FIG. 9 is a SEM photograph of a portion of the microstructure of FIG. 8 shown at higher magnification.
Figure 10:
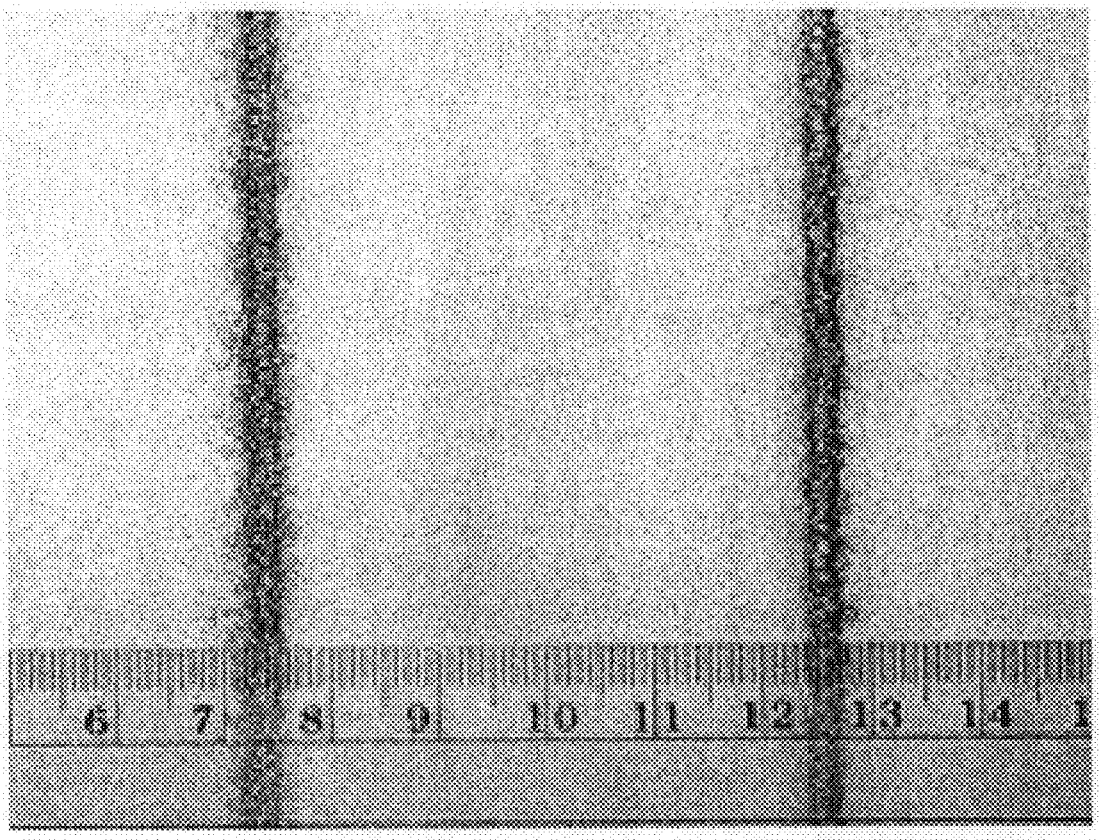
FIG. 10 is a plan view of high definition spray patterns produced in accordance with apparatus and methods of the present invention.

Scanning electron microscope (SEM) cross-sectional images (e.g., as would be seen in the cross-section of FIG. 2B) of the resulting etched coating 356 (see FIG. 7) are shown in FIG. 8 (1000×) and FIG. 9 (5000×). FIG. 10 illustrates a representative single pass coating produced with a 0.023 inch (0.584 mm) diameter first wire electrode 208 fed at 16 ft/min (4.9 m/min) at a current of 54 amps. The illustrated coatings of FIG. 10 are approximately 0.15 inches (3.8 mm) wide (width 124 in FIG. 2A) and 0.025 inches (0.64 mm) high (132 in FIG. 2B).

Discussion

Wire arc spray apparatus and methods of the present invention yield a narrow beam thermal spray for producing highly defined spray patterns having high density microstructures. As a result, masking and post-spray surface processing may be substantially reduced. Furthermore, the present invention allows for the formation of precise, free-standing structures which may be useful, for example, in rapid prototyping.

Many factors may contribute to the advantageous narrow beam spray produced by apparatus and methods of the present invention. For example, it is believed that generation and acceleration of the droplets 352 (See FIG. 7) at or near the center of the expanding gas jet contribute to development of the narrow beam spray.

Moreover, the fixed location of the second electrode 210 relative to the first wire electrode 208 is believed to permit substantially improved arc stability over devices that utilize two consumable electrodes or those utilizing electrode-to-nozzle arcing. For instance, it was discovered that, in the absence of the non-consumable second electrode 210, i.e., when primary arcing was permitted between the first wire electrode 208 and the gas nozzle 202, nozzle clogging and premature nozzle wear resulted. However, by using the second electrode 210 as described herein so that no primary arcing with the gas nozzle 202 occurred, a reduction in arc instability was realized which contributed to significantly reduced scattering of droplets 352 (see FIG. 7) during spraying. Furthermore, improved component, e.g., gas nozzle, life was also observed.

It has further been found that spray pattern divergence may also benefit from configuring the consumable, first wire electrode 208 as the anode, i.e., connecting the first wire electrode 208 to the positive terminal of the power supply, and the non-consumable, second electrode 210 as the cathode, i.e., connecting the second electrode 210 to the negative terminal of the power supply, as generally illustrated in FIG. 1. In fact, when the first wire electrode 208 was configured as the cathode, nonuniform and highly localized heating occurred. This heating led to violent emission of wire material, altering the wire geometry. As this process continued, droplets having random trajectories were produced. When these droplets were then introduced into the gas jet, divergent spray patterns resulted. However, when the first wire electrode 208 was configured as the anode, diffuse arc attachment resulted and the wire tip 208*a* (see FIG. 7) appeared to experience generally uniform heating. Such even heating produced generally equal size droplets at a consistent point within the gas jet flow. Accordingly, divergence of the spray was significantly reduced.

Another factor contributing to the narrow beam spray is the axial and radial orientation of the consumable first wire electrode 208 (see FIG. 5) relative to the gas nozzle 202 as well as to the non-consumable, second electrode 210. While not wishing to be bound to any particular theory, positioning the first electrode axis 270 at an angle 272 (see FIG. 5) appears to improve arc starting and reduce problems with arcing between the first wire electrode 208 and the gas nozzle 202. One possible explanation for this result is desirable boundary layer effects resulting from the accelerating arc gas 204 flowing between the first wire electrode 208 and the interior, e.g., bore 278, of the gas nozzle 202 as indicated by arrows 205. For example, as the first wire electrode 208 is positioned near the wall of the bore 278 proximate the area identified as 276 in FIG. 5, arc gas flow between the first wire electrode 208 and the wall of the bore 278 is impeded, i.e., the orientation of the first wire electrode 208 may act to partially "pinch off" arc gas flow proximate the gas nozzle exit 206. While the actual angle 272 may vary as discussed above, in one embodiment it was set to provide a radial distance 215 (see FIG. 7) separating the tip of the first wire electrode 208 from a tip of the second electrode 210 of approximately 0.10 inches (2.5 mm).

Yet another factor potentially contributing to the narrow beam spray produced by apparatus and methods of the present invention is the ability to control the arc attachment point on the second electrode. To control the arc attachment point, it is beneficial to maintain the geometry e.g., shape, of the arc attachment portion of the second electrode. In the embodiments illustrated herein, this is accomplished by providing control of the heat flux away from the arc attachment point to maintain a second electrode end temperature that is below the melting point of the second electrode material, yet high enough to ensure thermonic electron emission. Furthermore, it is beneficial to prevent or minimize second electrode erosion due to oxidation of the second electrode material.

Having a controlled arc attachment point is believed to be advantageous for several reasons. For example, predictable arc behavior results from the fixed location of the second electrode 210. In addition, the location of the second electrode 210 may be selected to avoid interference with the gas jet flow through the gas nozzle 202.

It is noted that, while the embodiments illustrated herein show a substantially perpendicular orientation of the second electrode 210 relative to the axis of the gas nozzle 202, configurations having non-perpendicular orientations may also be provided and still yield the benefits described herein. For example, the second electrode 210 could be oriented at an acute angle, e.g., 30 degrees, to the nozzle axis 274.

Thermally-sprayed coatings produced by known twin-wire systems result in microstructures that are somewhat porous and layered due to the impact of droplets on other molten, semi-molten, or solid droplets. As a result, these droplets form disc-like or pancake-like structures that stack on top of one another to form coatings similar to that shown in FIG. 12. Quite often, there is inadequate thermal energy to bond individual discs through flow processes or diffusion. In addition, in-flight oxidation of the droplets leads to increased porosity and thus increased and distinct layering of the coating as shown. The trend in thermal spray has thus been toward the generation of extremely fast (e.g., speed>300 meters/sec.) and small (e.g., diameter<50 microns) droplets to improve coatings quality through higher kinetic energy.

The microstructures produced with apparatus and methods of the present invention, on the other hand, reveal a very dense coating having a fine grain structure as illustrated in FIGS. 8 and 9. Such a microstructure appears similar in many respects to martensitic steel with banite, i.e., a microstructure indicative of very rapid cooling.

Figure 12:
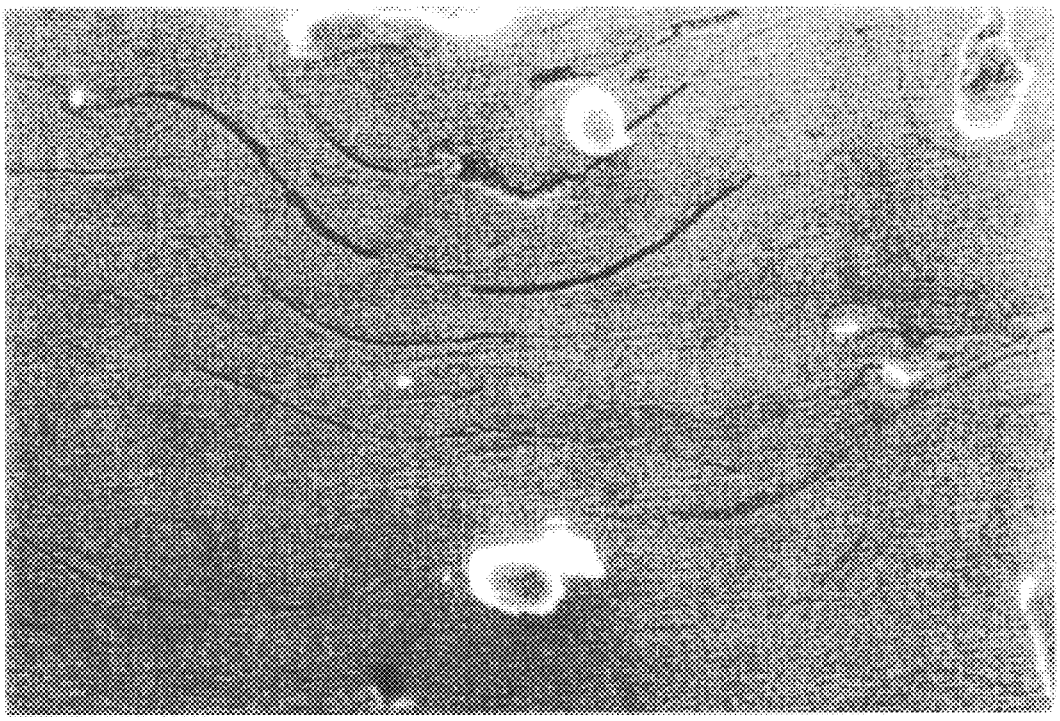
FIG. 12 is a SEM photograph illustrating a cross-sectional view of a coating microstructure applied by a conventional twin-wire apparatus.

As FIGS. 8 and 9 show, apparatus and methods of the present invention produce a high density microstructure having, unlike the structure of FIG. 12, substantially indiscernible boundaries between the individual droplets that constitute the coating. Such dense, uniform coatings are attributable to several factors. For example, the highly concentrated heat flux density through the narrow beam droplet spray results in high heat energy delivery to a very localized area, enhancing diffusion and flow between individual material droplets. High heat flux density also results in the droplets remaining fully molten on impact with the substrate, permitting droplet intermingling through convection and diffusion.

Once the droplets coat the substrate, high cooling rates are possible due in part to thermal transfer with the substrate itself. Furthermore, the larger droplet size produced by methods and apparatus of the present invention prevent excessive in-flight oxidation. As a result, oxide contaminants are less prevalent in the microstructure.

Because the droplets impact the substrate in a molten form, some splattering of individual droplets may result (see FIG. 10). This may be somewhat controlled, however, by reducing the kinetic energy, e.g., speed, of the droplets.

Apparatus and methods of the present invention, unlike conventional thermal spraying processes, yield these and other benefits from a spray consisting of slow moving (e.g., about 50–100 meters/sec), relatively large droplets (e.g., about 300–400 micron diameter). The relatively large size, slow speed, and controlled trajectory of these droplets contribute to producing the advantageous microstructures shown in FIGS. 8 and 9 and described herein.

Figure 11A:
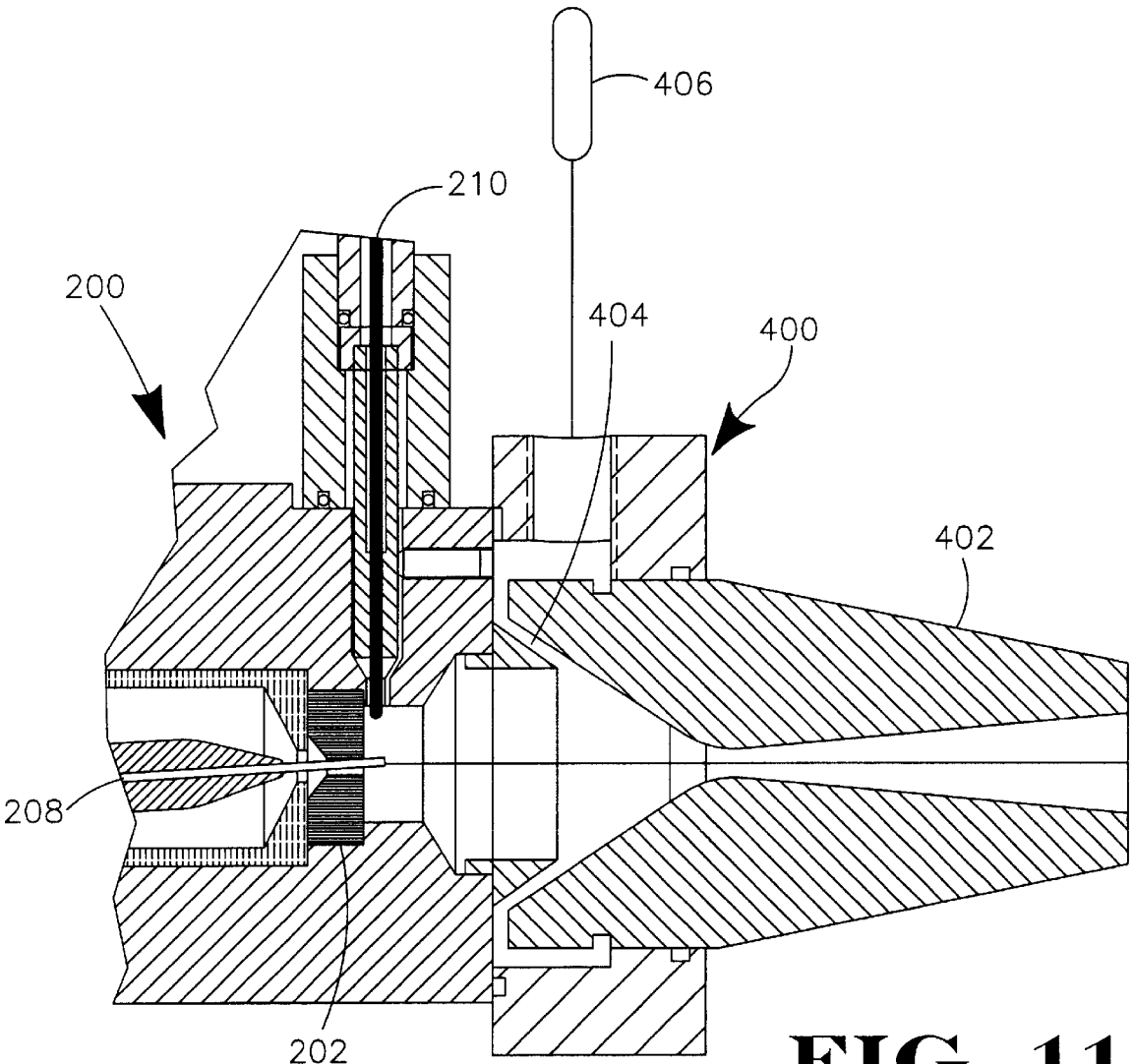
FIG. 11A is an enlarged cross-sectional view of a single-wire arc spray apparatus in accordance with yet another embodiment of the invention.
Figure 11B:
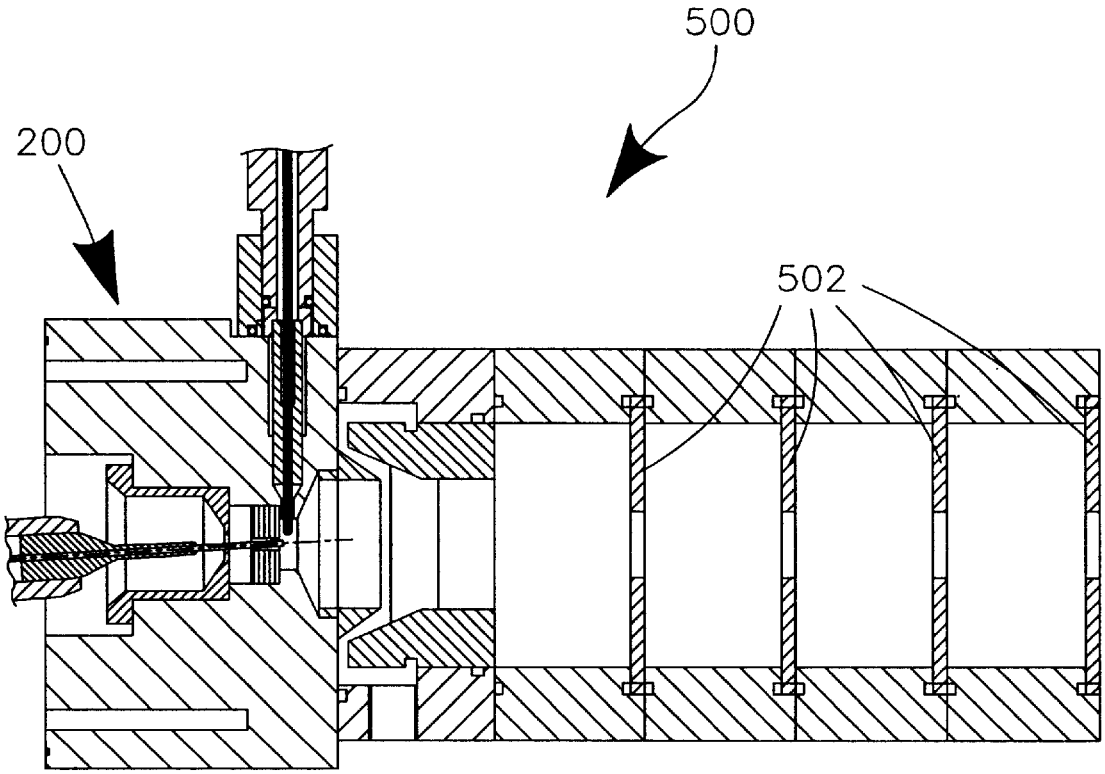
FIG. 11B is a cross-sectional view of a single-wire arc spray apparatus in accordance with yet another embodiment of the invention.

While described with respect to particular embodiments, modifications may certainly be made to the methods and apparatus described herein without departing from the scope of the invention. For example, gas nozzles made from electrically insulated materials, e.g., a refractory ceramic material, may be used to eliminate arcing to the nozzle. Furthermore, gas nozzles having different nozzle bore profiles, e.g., a converging/diverging profile, may also be used. Similarly, a second, accelerating nozzle assembly 400 having a second nozzle 402 as shown in FIG. 11A may be provided. In this particular embodiment, a third gas source 406 may optionally introduce another gas to the second nozzle 402 through the orifice 404. In still other embodiments, a system 500 having one or more aerodynamic lenses 502 as known in the art and shown in FIG. 11B may be combined with apparatus 200 of the present invention to further improve droplet beam focus.

In still other embodiments, a transferred arc (as diagrammatically represented by line 364 in FIG. 7) may be introduced between the single-wire arc spray apparatus, e.g., from the second electrode 210 or from a third electrode 366, and the substrate surface 354 to be coated. This transferred arc may increase heat transfer to the substrate surface, which may be beneficial to further increase coating quality, e.g., improve droplet adhesion and/or coating density.

Conclusion

Advantageously, single-wire arc spray apparatus and methods of the present invention produce a narrow beam thermal spray of liquid droplets for generating highly defined coatings with high density microstuctures. Such coatings may be formed from relative large, slow-moving droplets having high heat flux densities. By permitting precise control of the spray pattern, masking and post-spray surface processes may be eliminated or substantially reduced.

The complete disclosure of the patents, patent documents, and publications cited in the Background, Detailed Description and elsewhere herein are incorporated by reference in their entirety as if each were individually incorporated.

Exemplary embodiments of the present invention are described above. Those skilled in the art will recognize that many embodiments are possible within the scope of the invention. Other variations, modifications, and combinations of the various parts and assemblies can certainly be made and still fall within the scope of the invention. Thus, the invention is limited only by the following claims, and equivalents thereto.

What is claimed is:

1. A liquid material droplet generator, comprising:

a gas nozzle having a nozzle entrance, a nozzle exit, and a nozzle bore, the nozzle bore defining a nozzle axis;

a first consumable electrode positionable within the nozzle bore; and a second non-consumable electrode positionable outside the gas nozzle proximate the nozzle exit, the second non-consumable electrode defining a second electrode axis substantially perpendicular to the nozzle axis, wherein the second non-consumable electrode is located such that it does not interfere with a flow of a gas jet produced by the gas nozzle.

2. The generator of claim 1, wherein the second non-consumable electrode comprises one or more wires.

3. The generator of claim 1, wherein the second non-consumable electrode comprises a refractory metal material.

4. The generator of claim 3, wherein the refractory metal material comprises tungsten.

5. The generator of claim 1, further comprising a first gas source for delivering to the generator a first gas associated with the first consumable electrode.

6. The generator of claim 5, wherein the generator is adapted to accelerate the first gas through the gas nozzle to form a gas jet, the gas jet originating at the nozzle exit.

7. The generator of claim 5, further comprising a second gas source for delivering to the generator a second gas associated with the second non-consumable electrode.

8. The generator of claim 7, wherein the second gas is selected to at least protect the second non-consumable electrode from oxidation.

9. The generator of claim 7, wherein the second gas is selected from the group consisting essentially of inert gases and non-oxidizing gases.

10. The generator of claim 9, wherein the second gas is argon.

11. The generator of claim 7, wherein the first gas and the second gas comprise argon.

12. The generator of claim 1, wherein the first consumable electrode and the second non-consumable electrode are coupled to a direct current power supply.

13. The generator of claim 12, wherein the direct current power supply provides continuous current.

14. The generator of claim 12, wherein the direct current power supply provides a pulsed current between a maximum current level and a minimum current level.

15. The generator of claim 12, wherein the first consumable electrode is coupled to a positive terminal of the direct current power supply.

16. The generator of claim 12, wherein the second non-consumable electrode is coupled to a negative terminal of the direct current power supply.

17. The generator of claim 12, wherein the gas nozzle is coupled to a negative terminal of the direct current power supply.

18. The generator of claim 1, wherein the gas nozzle is electrically neutral.

19. The generator of claim 1, further comprising a second nozzle positionable proximate the nozzle entrance of the gas nozzle.

20. The generator of claim 19, wherein the second nozzle is electrically insulating.

21. The generator of claim 1, wherein the nozzle bore comprises a conical portion and a constant diameter portion.

22. A wire arc thermal spray apparatus, comprising:

a gas nozzle having a nozzle bore and a nozzle exit, the nozzle bore defining a nozzle axis;

a first consumable wire electrode positionable within the nozzle bore, wherein the first consumable wire electrode has a first axis; and a second non-consumable electrode located proximate the nozzle exit, wherein at least a portion of the second non-consumable electrode defines a second axis substantially perpendicular to the nozzle axis, and further wherein the second non-consumable electrode is positioned outside of a gas jet produced by the gas nozzle.

23. The apparatus of claim 22, further comprising an arc gas source adapted to provide an arc gas to the apparatus.

24. The apparatus of claim 23, further comprising a shroud gas source adapted to deliver a shroud gas to the apparatus, the shroud gas associated with at least a portion of the second non-consumable electrode.

25. The apparatus of claim 24, wherein the arc gas source and the shroud gas source are identical.

26. The apparatus of claim 22, wherein the first axis of the first consumable electrode is adjustable relative to the nozzle axis.

27. The apparatus of claim 22, wherein the first consumable electrode forms an anode and the second non-consumable electrode forms a cathode.

28. A liquid material droplet generating system, comprising:

a single-wire arc spray apparatus, comprising:

a gas nozzle having a nozzle entrance, a nozzle exit, and a nozzle bore, the nozzle bore defining a nozzle axis;

a first consumable electrode positionable within the nozzle bore, the first consumable electrode having a first electrode axis; and a second non-consumable electrode positionable outside the gas nozzle proximate the nozzle exit, wherein the second non-consumable electrode is positioned outside of a gas jet produced by the gas nozzle;

a power supply apparatus adapted to connect to at least the first consumable electrode and the second non-consumable electrode and operable to permit arcing between the first consumable electrode and the second non-consumable electrode;

a feeding apparatus adapted to feed the first consumable electrode through the nozzle bore; and a controller adapted to control one or more of the power supply apparatus and the feeding apparatus.

29. The system of claim 28, wherein at least a portion of the second non-consumable electrode defines a second electrode axis substantially perpendicular to the nozzle axis.

30. The system of claim 28, wherein the second non-consumable electrode comprises a wire.

31. The system of claim 28, wherein the first electrode axis forms an angle with the nozzle axis, wherein the angle is 5 degrees or less.

32. The system of claim 31, wherein the angle is 1 degree to 3 degrees.

33. The system of claim 28, wherein the power supply apparatus further comprises a high frequency arc starting unit and a direct current power source.

34. The system of claim 28, further comprising one or more gas sources for delivering one or more gases to the single-wire arc spray apparatus.

35. The system of claim 28, further comprising a first electrode positioning apparatus adapted to adjustably position the first consumable electrode relative to the gas nozzle.

36. The system of claim 28, wherein the second non-consumable electrode provides a fixed arc attachment point.

37. The system of claim 28, wherein the first consumable electrode is coupled to a positive terminal of the power supply apparatus and the second non-consumable electrode is coupled to a negative terminal of the power supply apparatus.

38. A method of generating a narrow beam thermal spray of liquid droplets, the method comprising:

providing a gas nozzle having a nozzle entrance, a nozzle exit, and a nozzle bore, the nozzle bore defining a nozzle axis;

positioning a first consumable electrode within the nozzle bore of the gas nozzle;

positioning a second non-consumable electrode outside of the gas nozzle proximate the nozzle exit, the position of the second non-consumable electrode selected to avoid interference with a gas jet produced by the gas nozzle; and forming an electrical arc outside of the gas nozzle proximate the nozzle exit, the electrical arc formed between a terminal end of the first consumable electrode and a portion of the second non-consumable electrode.

39. The method of claim 38, wherein at least a portion of the second non-consumable electrode defines a second electrode axis substantially perpendicular to the nozzle axis.

40. The method of claim 38, wherein forming the electrical arc comprises connecting the first consumable electrode and the second non-consumable electrode to a power source.

41. The method of claim 38, wherein the method further comprises accelerating a first arc gas through the gas nozzle to form a gas jet originating at the nozzle exit.

42. The method of claim 41, wherein forming the electrical arc causes a portion of the first consumable electrode to melt and form droplets near a center of the gas jet.

43. The method of claim 42, further comprising operatively adjusting a flow rate of the first arc gas to control one or more of a droplet size, a droplet initial velocity, a droplet temperature, and a droplet trajectory.

44. The method of claim 42, further comprising adjusting a current delivered to the electrical arc to control one or more of a droplet size, a droplet initial velocity, a droplet temperature, and a droplet trajectory.

45. The method of claim 42, further comprising selecting a material of the first consumable electrode to control one or more of a droplet size, a droplet initial velocity, a droplet temperature, and a droplet trajectory.

46. The method of claim 42, further comprising positioning the first consumable electrode within the nozzle bore to control one or more of a droplet size, a droplet initial velocity, a droplet temperature, and a droplet trajectory.

47. The method of claim 42, further comprising:

detaching the droplets from the first consumable electrode with the gas jet; and carrying the droplets with the gas jet, wherein the droplets form the narrow beam thermal spray.

48. The method of claim 47, further comprising delivering the droplets to one or more substrate surfaces.

49. The method of claim 48, further comprising applying a coating to the one or more substrate surfaces, the coating having a substantially uniform thickness.

50. The method of claim 47, wherein the droplets carried by the gas jet have a droplet diameter of 300 to 400 microns.

51. The method of claim 47, wherein the droplets carried by the gas jet have a droplet velocity of 50 to 100 meters/second.

52. The method of claim 47, further comprising delivering the droplets to a surface, wherein the droplets solidify to form a coating having a high density microstructure with substantially indiscernible boundaries between the droplets forming the coating.

53. The method of claim 52, wherein the coating has a single pass aspect ratio of coating height to coating width of 1:0.5 to 1:10.

54. The method of claim 53, wherein the coating forms a radius of curvature equal to or greater than R, where R is equal to one half of the coating width.

55. The method of claim 47, further comprising directing the narrow beam thermal spray through one or more aerodynamic lenses.

56. The method of claim 47, wherein the narrow beam thermal spray has an angle of divergence from the nozzle axis of the gas nozzle of 10 degrees or less.

57. The method of claim 56, wherein the angle of divergence is 5 degrees or less.

58. The method of claim 57, wherein the angle of divergence is 2 degrees or less.

59. The method of claim 58, wherein the angle of divergence is 1 degree or less.

60. The method of claim 38, further comprising providing an electrically insulating nozzle proximate the nozzle entrance of the gas nozzle.

61. The method of claim 38, further comprising forming a second arc between the second non-consumable electrode and a substrate.

62. The method of claim 38, further comprising forming a second arc between a third electrode and a substrate.

63. A method for forming a high density microstructure, the method comprising:

providing a gas nozzle having a nozzle entrance, a nozzle exit, and a nozzle bore, the nozzle bore defining a nozzle axis;

positioning a first consumable electrode within the nozzle bore of the gas nozzle;

positioning a second electrode outside of the gas nozzle and proximate the nozzle exit;

accelerating a first arc gas through the gas nozzle to form a gas jet at the nozzle exit;

forming an electrical arc outside of the gas nozzle proximate the nozzle exit, the electrical arc formed between a terminal end of the first consumable electrode and a portion of the second electrode, wherein the electrical arc causes a portion of the first consumable electrode to melt and form droplets near a center of the gas jet, forming a narrow beam thermal spray; and depositing the droplets on a substrate surface to form a coating, where the coating is defined by substantially indiscernible boundaries between the droplets that form the coating.

64. The method of claim 63, wherein the second electrode is a non-consumable, wire electrode.

65. The method of claim 64, wherein forming the electrical arc comprises forming the electrical arc between a terminal portion of the first consumable electrode and a terminal portion of the second electrode.

66. The method of claim 63, further comprising controlling one or more of a droplet size, an angular divergence of the narrow beam thermal spray, and a droplet temperature.

67. A wire arc thermal spray apparatus for generating a narrow beam thermal spray, the apparatus comprising:

a gas nozzle having a nozzle bore and a nozzle exit, the nozzle bore defining a nozzle axis, the gas nozzle operable to produce a gas jet;

a first consumable electrode positioned within the nozzle bore, wherein the first consumable electrode has a first axis that forms an angle with the nozzle axis of 5 degrees or less; and a second non-consumable electrode positioned outside the gas nozzle proximate the nozzle exit, wherein a terminal portion of the second non-consumable electrode is positioned outside of the gas jet such that an arc may form between the first consumable electrode and the second non-consumable electrode.

68. The apparatus of claim 91, wherein the angle is 1 degree to 3 degrees.

69. The apparatus of claim 91, wherein the angle between the first axis and the nozzle axis is adjustable.

70. The apparatus of claim 67, wherein the first consumable electrode forms an anode and the second non-consumable electrode forms a cathode.

71. The apparatus of claim 67, wherein the gas nozzle is adapted to accelerate a first gas to form the gas jet.

72. The apparatus of claim 67, wherein the first consumable electrode and the second non-consumable electrode are coupled to a direct current power supply.

73. The apparatus of claim 72, wherein the direct current power supply provides continuous current.

74. The apparatus of claim 72, wherein the direct current power supply provides a pulsed current between a maximum current level and a minimum current level.

75. The apparatus of claim 72, wherein the first consumable electrode is coupled to a positive terminal of the direct current power supply and the second non-consumable electrode is coupled to a negative terminal of the direct current power supply.

76. The apparatus of claim 72, wherein the gas nozzle is coupled to a negative terminal of the direct current power supply.

77. The apparatus of claim 67, further comprising a second nozzle proximate the nozzle entrance of the gas nozzle.

78. The apparatus of claim 77, wherein the second nozzle is electrically insulating.

79. The apparatus of claim 67, wherein the second non-consumable electrode is adapted to emit electrons thermonically.

80. A method of generating a narrow beam thermal spray of liquid droplets, the method comprising:

providing a gas nozzle having a nozzle entrance, a nozzle exit, and a nozzle bore, the nozzle bore defining a nozzle axis;

positioning a first consumable electrode within the nozzle bore of the gas nozzle;

positioning a second non-consumable electrode outside of the gas nozzle proximate the nozzle exit;

accelerating a first arc gas through the gas nozzle to form a gas jet originating at the nozzle exit;

forming an electrical arc outside of the gas nozzle proximate the nozzle exit, the electrical arc formed between a terminal end of the first consumable electrode and a portion of the second non-consumable electrode that is outside of the gas jet;

detaching the droplets from the first consumable electrode with the gas jet; and carrying the droplets with the gas jet, wherein the droplets form the narrow beam thermal spray.

81. The method of claim 80, wherein at least a portion of the second non-consumable electrode defines a second electrode axis substantially perpendicular to the nozzle axis.

82. The method of claim 80, wherein forming the electrical are comprises connecting the first consumable electrode and the second non-consumable electrode to a power source.

83. The method of claim 80, wherein positioning the first consumable electrode within the nozzle bore of the gas nozzle comprises orienting the first consumable electrode such that a first electrode axis of the first consumable electrode forms an angle with the nozzle axis.

84. The method of claim 83, wherein the angle is 5 degrees or less.

85. The method of claim 84, wherein the angle is 1 degree to 3 degrees.

86. The method of claim 80, wherein the narrow beam thermal spray has an angle of divergence from the nozzle axis of the gas nozzle of 10 degrees or less.

87. The method of claim 86, wherein the angle of divergence is 5 degrees or less.

88. The method of claim 87, wherein the angle of divergence is 2 degrees or less.

89. The method of claim 88, wherein the angle of divergence is 1 degree or less.

90. The method of claim 80, wherein the droplets carried by the gas jet have a droplet diameter of 300 to 400 microns.

91. The method of claim 80, wherein the droplets carried by the gas jet have a droplet velocity of 50 to 100 meters/second.

92. The method of claim 80, further comprising delivering the droplets to a surface, wherein the droplets solidify to form a coating having a high density microstructure with substantially indiscernible boundaries between the droplets forming the coating.

93. A liquid material droplet generator, comprising:

a gas nozzle comprising a nozzle bore, the nozzle bore defining a nozzle axis;

a first consumable electrode positionable within the nozzle bore, wherein the first consumable electrode comprises a first electrode axis which forms an angle with the nozzle axis of 1 degree to 3 degrees; and a second non-consumable electrode positionable outside the gas nozzle proximate the nozzle exit.

94. A wire arc thermal spray apparatus, comprising:

a gas nozzle having a nozzle bore and a nozzle exit, the nozzle bore defining a nozzle axis;

a first consumable wire electrode positionable within the nozzle bore, wherein the first consumable wire electrode has a first axis that forms an angle with the nozzle axis of 1 degree to 3 degrees; and a second non-consumable electrode proximate the nozzle exit, wherein the second non-consumable electrode defines a second axis substantially perpendicular to the nozzle axis.

95. A method of generating a narrow beam thermal spray of liquid droplets, the method comprising:

providing a gas nozzle having a nozzle exit and a nozzle bore, the nozzle bore defining a nozzle axis;

positioning a first consumable electrode within the nozzle bore of the gas nozzle such that a first electrode axis of the first consumable electrode forms an angle with the nozzle axis of 1 degree to 3 degrees;

positioning a second non-consumable electrode outside of the gas nozzle proximate the nozzle exit; and forming an electrical arc outside of the gas nozzle proximate the nozzle exit, the electrical arc formed between the first consumable electrode and the second non-consumable electrode.

* * * * *